US006648726B2

(12) United States Patent
Hornsby et al.

(10) Patent No.: US 6,648,726 B2
(45) Date of Patent: Nov. 18, 2003

(54) TOY GUN AND GLOW IN THE DARK PROJECTILE

(75) Inventors: James E. Hornsby, St. Louis, MO (US); Paul M. Brown, St. Louis, MO (US); Chad P. Stuemke, St. Louis, MO (US); Ryan A. Wolfinbarger, Littleton, CO (US)

(73) Assignee: All Seasons Toys, Inc, Malibu, CA (US)

( * ) Notice: Subject to any disclaimer, the term of this patent is extended or adjusted under 35 U.S.C. 154(b) by 0 days.

(21) Appl. No.: 09/952,361

(22) Filed: Sep. 11, 2001

(65) Prior Publication Data

US 2002/0081939 A1 Jun. 27, 2002

Related U.S. Application Data

(60) Provisional application No. 60/232,285, filed on Sep. 13, 2000.

(51) Int. Cl.[7] ..... A63H 13/00

(52) U.S. Cl. ..... 446/483; 446/175; 124/56; 124/16

(58) Field of Search ..... 446/483, 475, 446/400–404, 144–145, 175, 484, 219; 124/57, 58, 26, 56, 59; 473/416; 273/DIG. 24

(56) References Cited

U.S. PATENT DOCUMENTS 4,159,705 A 7/1979 Jacoby
5,186,156 A 2/1993 Clayton
5,373,832 A 12/1994 D'Andrade
5,373,833 A 12/1994 D'Andrade
5,415,151 A 5/1995 Fusi et al.
5,531,210 A 7/1996 Meiser et al.
5,596,978 A 1/1997 Johnson et al.
5,645,038 A 7/1997 Luk
5,653,215 A * 8/1997 Chung et al. ..... 124/66
5,680,853 A 10/1997 Clayton
5,878,734 A 3/1999 Johnson et al.
5,988,152 A 11/1999 Halter et al.
6,048,280 A * 4/2000 Palmer et al. ..... 473/416
6,119,671 A * 9/2000 Smith et al. ..... 124/59
6,279,562 B1 * 8/2001 Clayton ..... 124/59

* cited by examiner

*Primary Examiner*—Jacob K. Ackun
*Assistant Examiner*—Jamila O Williams
(74) *Attorney, Agent, or Firm*—Richard B. Klar

(57) ABSTRACT

A system and a method for launching glow-in-the-dark projectiles from a projectile launcher wherein the toy comprises projectiles exposed to light prior to being launched and a firing mechanism wherein a portion of the firing mechanism is positioned with the projectile prior to being fired from the launcher. In one embodiment, the firing mechanism comprises a light for exposing the projectile to radiation prior to being fired from the gun. The present invention is well suited for use as a toy projectile launcher wherein the toy may be used in dark or low-light areas.

19 Claims, 23 Drawing Sheets

TOY GUN AND GLOW IN THE DARK PROJECTILE

RELATED APPLICATION

This application claims priority from a U.S. Provisional Application, Ser. No. 60/232,285, filed Sep. 13, 2000, the entire disclosure of which is incorporated herein by reference.

TECHNICAL FIELD OF THE INVENTION

The present invention relates to a toy device for launching or firing glow-in-the-dark projectiles. The toy comprises projectiles exposed to light prior to being launched and a firing mechanism wherein a portion of the firing mechanism is positioned with the projectile prior to being fired from the launcher. More specifically, the present invention relates to a toy launching device having a phosphorescent-activating radiation source which activates glow-in-the-dark projectiles before the projectiles are launched from the projectile launcher.

BACKGROUND OF THE INVENTION

It is recognized in the toy art that glow-in-the-dark objects and toys are appealing to both adults and children. It is also known in the toy art that toy launching devices, i.e., toy guns, sling shots, bows and arrows, etc., are appealing to both adults and children. Normally, people are not able to play with toys in the dark either because they can not see the appealing aspects of the toy or they would not be able to see another person who may be playing along. A toy gun which launches glow-in-the-dark projectiles would allow the user to play with the device in the dark while still being able to visibly see the projectile. The dark would actually enhance the appealing aspects of the present invention.

A related invention in the art of launching phosphorescent projectiles from a launcher is disclosed in the U.S. Pat. No. 5,415,151 (Fusi et al). This patent utilizes a combination of a toy launcher along with a phosphor-containing projectile. The launcher comprises means for launching the phosphor-containing projectiles outwardly from the launcher, and means for exposing the projectiles within the launcher to phosphorescence-activating radiation prior to the projectile leaving the launcher. The disclosed means for exposing the projectile to phosphorescence-activating radiation prior to the projectile leaving the launcher are a plurality of lighting elements on the inner surface of the barrel and/or a lighting element in or about the breech. The lighting elements in the breech illuminate the projectile prior to its being fired or launched from the breech. The lighting elements in the barrel illuminate the projectile after it is launched from the breech but before it leaves the barrel. However, the Fusi et al. device does not provide for an radiation exposing device located immediately adjacent to or attached to a firing mechanism for exposing the projectile to phosphorescence-activating radiation prior to the projectile being launched. Also, while the Fusi et al. device may be well-suited for its intended purpose, it does not optimize the exposure of projectile to light.

There is a need in the art for a toy launcher where a portion of the firing mechanism is positioned within a glow-in-the-dark projectile prior to being fired in order to enhance firing capabilities. In addition, there is a need in the art for an toy launcher for launching glow-in-the-dark projectiles where the projectiles are exposed to phosphorescent-activating radiation by an exposing means located adjacent to or attached to the firing mechanism. Using the firing mechanism to expose the projectiles to phosphorescent-activating radiation will maximize exposure to the projectile while minimizing the energy required to illuminate the exposure device. In addition, positioning the exposure device adjacent to or attached to the firing mechanism will enhance uniform radiation exposure to the glow-in-the-dark projectile.

Accordingly, the present invention provides a toy that fires projectiles that glow in the dark. The glow in the dark projectiles allow the toy gun to effectively be used in the dark. The present invention may be used to expose the glow-in-the-dark projectiles to phosphorescent-activating radiation prior to the projectile being loaded in the gun. The present invention may expose the glow-in-the-dark projectiles to phosphorescent-activating radiation by exposing means located within or attached adjacent to the firing mechanism.

The present invention may provide within the firing mechanism of the launching device a firing pin wherein the radiation exposure device may be located. The exposure device may be activated either through actuation of the firing mechanism or separately activated. The exposure device may then expose the glow-in-the-dark projectiles to phosphorescent-activating radiation prior to the projectile being launched from the projectile launcher.

SUMMARY OF THE INVENTION

The present invention provides an apparatus for use as a toy that comprises a projectile launcher and a projectile which glows in the dark. The projectile launcher comprises a firing mechanism wherein a portion of the firing mechanism is positioned within the projectile before being fired. In one embodiment, the projectile launcher may comprise a firing mechanism comprising a light source for exposing the projectiles to radiation prior to being launched from the launcher. The present invention is particularly suited for use as a toy projectile launcher wherein the toy may be used in dark or low-light areas.

In one embodiment the projectile launcher comprises a body, a trigger mechanism, a firing mechanism, and a pumping system. In some embodiments the launcher may also comprise a tank. In some embodiments, the projectile launcher may also comprise a projectile container, i.e., a clip or a magazine. In different embodiments, these components can be arranged differently in order to create a different looking projectile launcher with different capabilities. For instance, in some embodiments, the body may be smaller, or have a different shape. In these embodiments, the pumping mechanism may be set in different locations on the body for convenience, or, in order to accommodate for the lack of space, the projectile magazine may contain more or less projectiles, or the size of the parts of the mechanisms may be larger or smaller.

In some embodiments, the light source may be in the form of visible light and would expose the projectiles prior to being launched from the launcher in order to activate or excite the molecules to go into a state of spontaneous radiation emission. The length of time of the emission may persist for long periods, even hours, but characteristically minutes or seconds, depending on the phosphorescent material used.

The projectiles may be held in a container or clip. The clip may be inserted and removed from the gun through the use of a mechanical locking and unlocking system. The clip can be made to hold a selected number of projectiles, and can have a spring system included in order to continuously load the next projectile into a barrel of the projectile launcher. The clip may be larger or smaller, and hold fewer or more projectiles, depending on the capabilities of the body to hold a certain sized clip.

The body of the gun may also be optionally equipped with a scope. In one embodiment, the scope may have a magnifying lens to make objects appear closer. In another embodiment, a light emitting diode of any visible color could be located in the body and, when activated, emit light through a pinhole. The light could then be reflected off of a reflecting surface, oriented so as to reflect the emitted light to a specific point on a lens located at the opposite end of the scope as a user's eye. This could give the user a view through the scope of a target with a small red dot projected onto it, thus giving the illusion of "laser" targeting.

The gun may be equipped with a trigger mechanism, which a user activates to initiate launching of a projectile. In one embodiment, the trigger mechanism comprises a trigger, a trigger arm, a gear system, and a drawing pin. The trigger may take the appearance of virtually any known trigger, and could be made to support a trigger arm, which would act as a connection piece from the trigger to a gear system. The trigger may optionally be designed to activate a switch when it has been activated by a user, which could cause light emitting diodes placed in the body to activate. In one embodiment, the trigger could activate a switch that activates the light emitting diode in a scope. In other embodiments, the trigger could activate a switch that activates other light emitting diodes located on the body to make the gun aesthetically pleasing to the eye.

In one embodiment, the trigger arm could act as a connector for the trigger and the gear system. The trigger arm could be longer or shorter, depending on the shape of the body, and the desired placement of the firing mechanism in relation to the trigger. In one embodiment, the end of the trigger arm connecting to the gear system has splines on it to interact with a drive gear, so that when the trigger arm moves, the drive gear would turn.

The gear system of the trigger mechanism could be made up of many gears acting in concert, or just one drive gear, depending on the design of the system. The gear system may connect the trigger arm and a drawing pin in the trigger mechanism. In one embodiment, a drive gear and transfer gear can be used, so that movement of the trigger arm could cause the drive gear to rotate, and act on the transfer gear, which could be in contact with the drawing pin, and cause it to move a certain direction.

The drawing pin of the trigger mechanism could be used to draw back a firing mechanism when the trigger is activated. In one embodiment, the drawing pin is connected to a gear system and a firing mechanism. The drawing pin could be shaped so that it is able to connect to a gear system, draw a firing mechanism against a spring force, and release the connection at a point where the firing mechanism has been drawn back a certain distance. In one embodiment, the draw pin could have a "living hinge," as shown in the Figures, which would allow the draw hinge to let go of the firing pin at a predetermined point when drawing it back, and can reset itself into a position to draw back the firing mechanism again after it initially releases the firing mechanism.

In one embodiment, the firing mechanism comprises a barrel, a valve system, a firing pin and a firing spring. In one embodiment, the firing mechanism can be located in the body of the launcher adjacent to the barrel, and located so that the firing pin may interact with the projectiles as they are loaded into the barrel from the magazine or clip.

In one embodiment, the firing mechanism is connected to a tank containing a gas under pressure. In one embodiment, the gas is air, and is loaded into the tank via a pump system. The firing mechanism can be connected to the tank with a hose connecting the tank to the valve of the firing mechanism. In one embodiment, the valve is located in a housing, having a generally tubular, substantially hollow appearance, which is connected to the firing pin. In one embodiment, the valve of the firing mechanism can comprise a gasket connected to a valve pin and a knocker carried on a spring. The gasket may be located on one side of the valve housing, located between an inlet from the tank, and the connection to the firing pin, closing off an opening. The knocker and spring assembly could be located on the other side of the valve housing, so that the valve pin has the knocker attached to one end that protrudes from the valve housing with the spring in between the knocker and the end of the valve housing, with the other end of the valve pin going through the valve housing, and being attached to the gasket. In one embodiment, the firing mechanism may move in one direction when released by the trigger mechanism, so that the knocker comes into contact with a static surface. This could cause the valve pin to displace inside of the valve housing against the force of the valve spring. This displacement could move the gasket, causing gas from the tank to enter the valve housing, and enter the firing pin. If the knocker then ceases contact with a static surface, the force of the valve spring could replace the system, causing the gasket to once again seal off the opening from the tank to the valve housing.

In one embodiment, the valve housing could be connected to a firing pin. The firing pin could have a generally tubular, substantially hollow housing. The firing pin can connect to the valve housing through a side of the firing pin housing, and have one end of the pin housing enclosed, and the other end open. The enclosed end could be attached to a main firing spring, which could resist compression between the firing pin and a static surface. The open end of the firing pin could face an end of the barrel, so that projectiles located in the barrel can interact with the open end of the firing pin. In one embodiment, the outer perimeter of the pin housing is able to fit inside of the hollow end portion of the projectiles.

The firing pin can also be connected to the draw pin of the trigger mechanism, so that when the draw pin moves with the trigger mechanism, the firing pin mechanism will move with the draw pin against the force of the main firing spring. At a predetermined position, the firing pin housing could be released from the draw pin. The restoring force from the main firing spring could cause the firing mechanism to move in a direction towards the barrel, so that the open end of the firing pin comes into contact with the projectile in the barrel, and the knocker of the valve system contacts a static surface. In one embodiment, when this happens, a burst of gas from the pressurized tank can run through the valve housing, into the firing pin, out of the open end of the firing pin, and into the projectile, sending the projectile through the barrel and out of the gun.

In another embodiment, the firing mechanism may be motorized, whereby the trigger actuates a motor to cause the motorized movement of the transfer gears. The transfer gear in this embodiment causes the firing mechanism to be drawn back against a spring force. The gear system may disengage, causing the firing mechanism to release and project forward causing the firing pin to enter the projectile. The firing mechanism would be simultaneously connected to a motorized pumping system for launching the projectile from the launcher.

The light source used to activate the glow-in-the-dark projectiles may be located adjacent to or attached to the firing pin of the firing mechanism. A switch for activating the light source may be positioned so that the forward movement of the firing mechanism closes the switch to activate the light source while the firing pin is moving forward into the projectile, when it has reached the extent of its travel into the projectile, or as it is moved relatively to the projectile.

The tank of the gun can have any shape or form. In one embodiment, the tank is designed to hold a gas under pressure. The tank can have an inlet coming from a pump system, and an outlet going to a firing mechanism. The inlet and outlet can be in the form of hoses, and one-way valves could be located in both the inlet and outlet, in order to keep the tank pressurized while allowing gas to be pumped in. In one embodiment, the tank has a purge valve, which may be designed so that when the tank is at a certain pressure, the purge valve could allow gas to leak out of the tank, to avoid over pressurizing the tank, and causing the tank to leak, break, or burst.

The pumping system of the invention can be designed to pump gas into the tank of the launcher. In one embodiment, the pumping system comprises a manual, hand pump system. This system could be located on the edge, or outside of the body, so that a user may manually pump gas into the tank. In this embodiment, the pumping system could comprise a pump arm, a pump body, and a connection to the tank.

In another embodiment, the pump system comprises a motor, located inside the body, designed to simultaneously causes the firing mechanism to draw back and enter into the projectile, exposing it to light, while also pumping air into the pump body and out the firing pin to launch the projectile. In another embodiment, the motor would automatically pump air into a tank and the firing mechanism would not be motorized, and instead be manually driven by the trigger mechanism interacting with the firing mechanism.

While multiple embodiments are disclosed, still other embodiments of the present invention will become apparent to those skilled in the art from the following detailed description, wherein is shown and described by way of illustration best modes contemplated for carrying out the invention. As will be realized, the invention is capable of modifications in various aspects, all without departing from the spirit and scope of the present invention. Accordingly, the drawings and detailed description are to be regarded as illustrative in nature and not restrictive.

BRIEF DESCRIPTION OF THE DRAWINGS

FIG. 11, including

DETAILED DESCRIPTION

With regard to fastening, mounting, attaching or connecting the components of the present invention to form the projectiles, launcher, or the toy as a whole, unless specifically described otherwise, such are intended to encompass conventional fasteners such as nut and bolt-type connectors, threaded connectors, snap members, clamps and the like, rivets, toggles, pins and the like. Components may also be connected by welding, friction fitting, adhesion, or deformation, if appropriate. Any known power source may be used in embodiments requiring power. Electrical connections may be made using appropriate electrical components and connection methods, including conventional components and connectors, including a computer or chips where appropriate, and including appropriate power sources, which may include batteries, rechargeable battery pack type devices or plug-in arrangements. Light and sound displays may be provided by appropriate devices such as sound chips, speakers, light sources, bulbs, LED's, etc. Unless specifically otherwise disclosed or taught, materials for making components of the present invention are selected from appropriate materials such as metal, metallic alloys, fibers, plastics and the like, and appropriate manufacturing or production methods including casting, extruding, molding and machining may be used.

Figure 1:
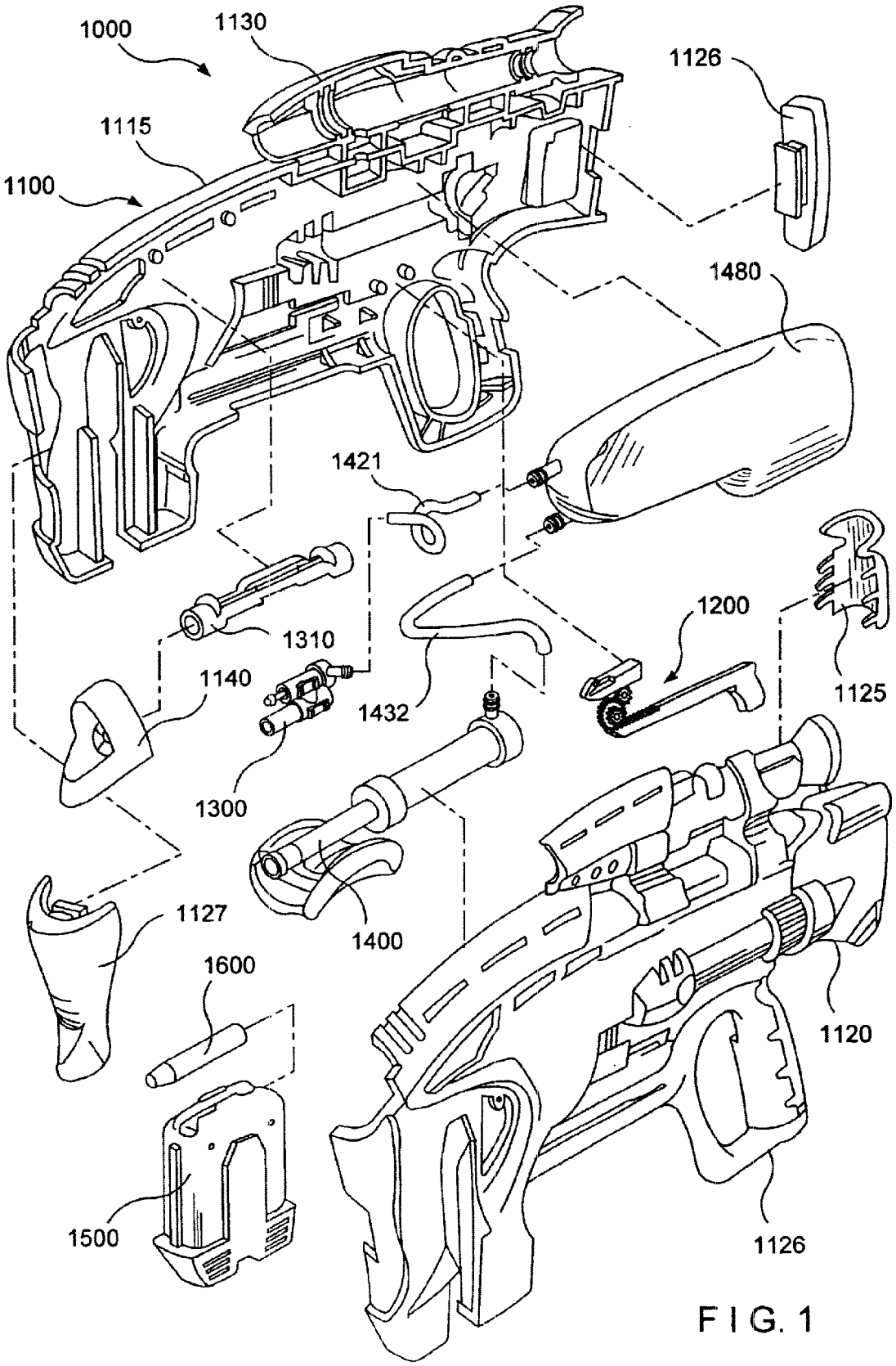
FIG. 1 is a perspective view of one embodiment of the present invention.

Any references to front and back, right and left, top and bottom and upper and lower are intended for convenience of description, not to limit the present invention or its components to any one positional or spacial orientation FIG. 1 is a perspective view of an embodiment of the present invention. The launcher 1000 comprises a body portion 1100, a trigger assembly 1200, a firing mechanism 1300, a barrel 1310, a pump assembly 1400, and a tank 1480. The body portion 1100 may be comprised of a molded right shell portion 1115 and a left shell portion 1120 and a handle 1122 with grip 1125. The launcher 1000 may also have a scope 1130, a clip 1500, a nose cone 1140 and a back handle 1126 and a front handle 1127.

Figures 2, 2A:
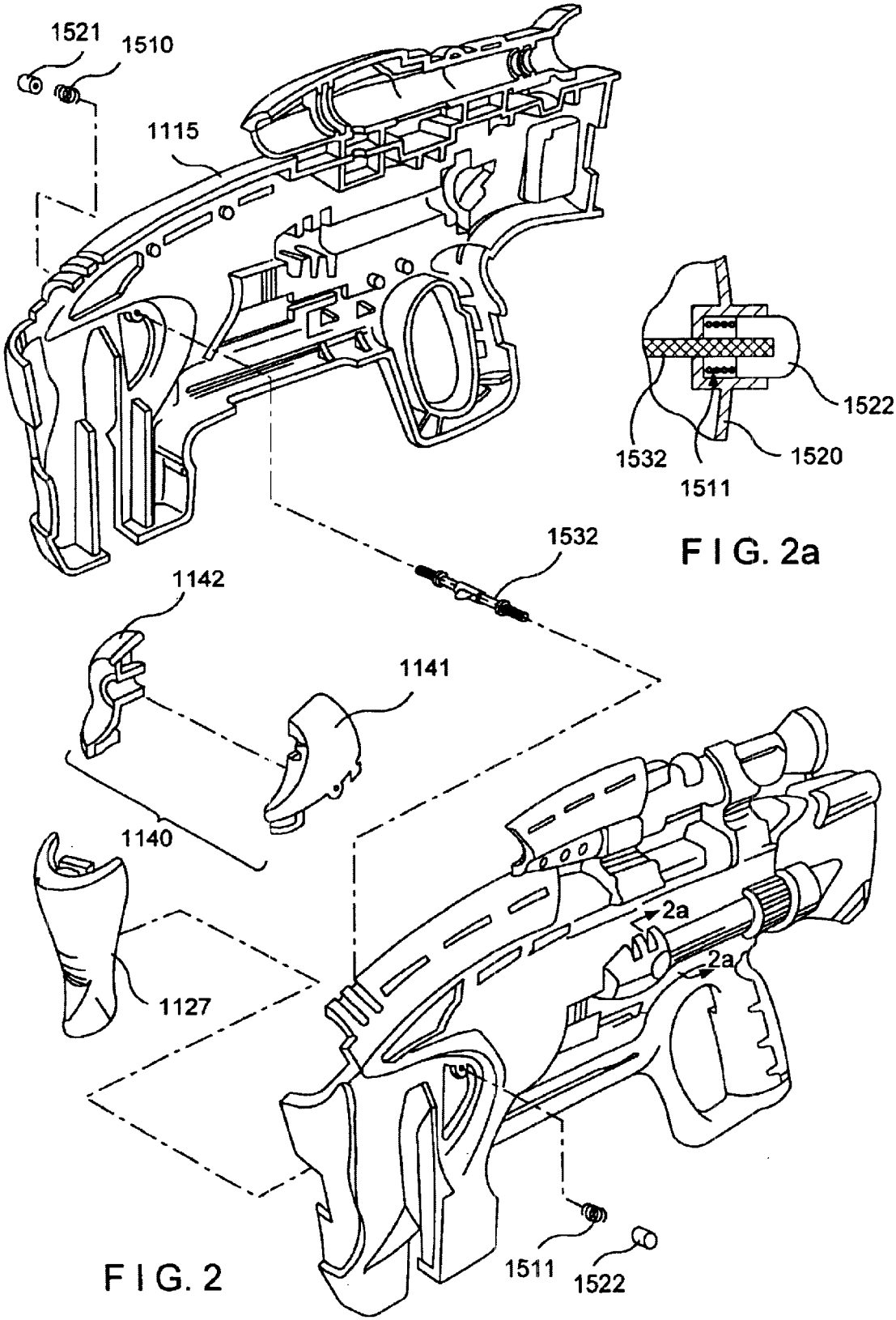
FIG. 2 is a perspective view of a clip release mechanism and a nose cone for an embodiment of the present invention.

FIG. 2 is a perspective view of a clip release mechanism 1530 and nose cone 1140 for an embodiment of the present invention. The clip release mechanism 1530 comprises a clip release 1532 that extends through the left shell housing 1120 to the right shell housing 1115. On the exterior of each shell housing is a release button 1520, 1521 separated from the clip release arm 1532 by release springs 1510, 1511. The release springs 1510, 1511 return the respective buttons to the exterior of the shell housing following depression. The nose cone 1140 may be comprised of a left nose cone 1141 and a right nose cone 1142, and may be formed separately (as shown) or integrally with the body.

Figure 3:
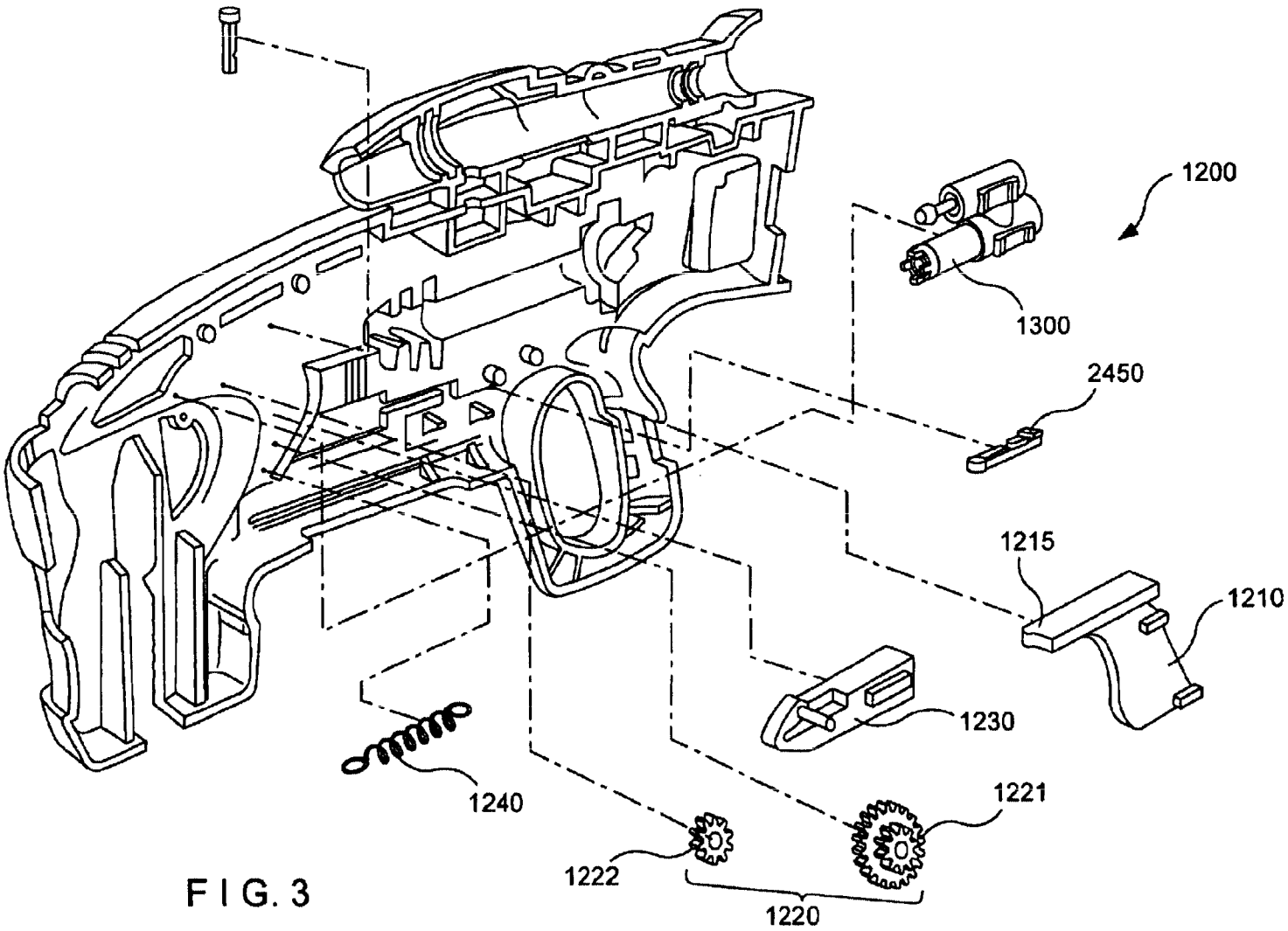
FIG. 3 is an exploded assembly of a trigger mechanism for an embodiment of the present invention.

FIG. 3 is an exploded assembly of the trigger mechanism 1200 for the device of FIG. 1. The trigger mechanism 1200 would be used to initiate launching of a projectile. The trigger mechanism comprises a trigger 1210, a trigger arm 1215, a gear system 1220, and a drawing pin 1230. Attached to the end of the trigger arm 1215 is an expansion spring 1240 for returning the trigger 1210 to a resting position following firing. The trigger 1210 may use the trigger arm 1215 to activate the gear system 1220. The gear system 1220 may comprise a drive gear 1221 or both a drive gear 1221 and a transfer gear 1222 depending on the design of the system. The end of the trigger arm 1215 may have splines to interact with the drive gear 1221. The gear system 1220 operates to transfer movement from the trigger arm 1215 to the drawing pin 1230.

The trigger 1210 may take the appearance of virtually any known trigger, and could be made to support a trigger arm 1215. The trigger arm 1215 could be longer or shorter, depending on the shape of the body, and the desired placement of the firing mechanism 1300 in relation to the trigger 1210.

Figure 4:
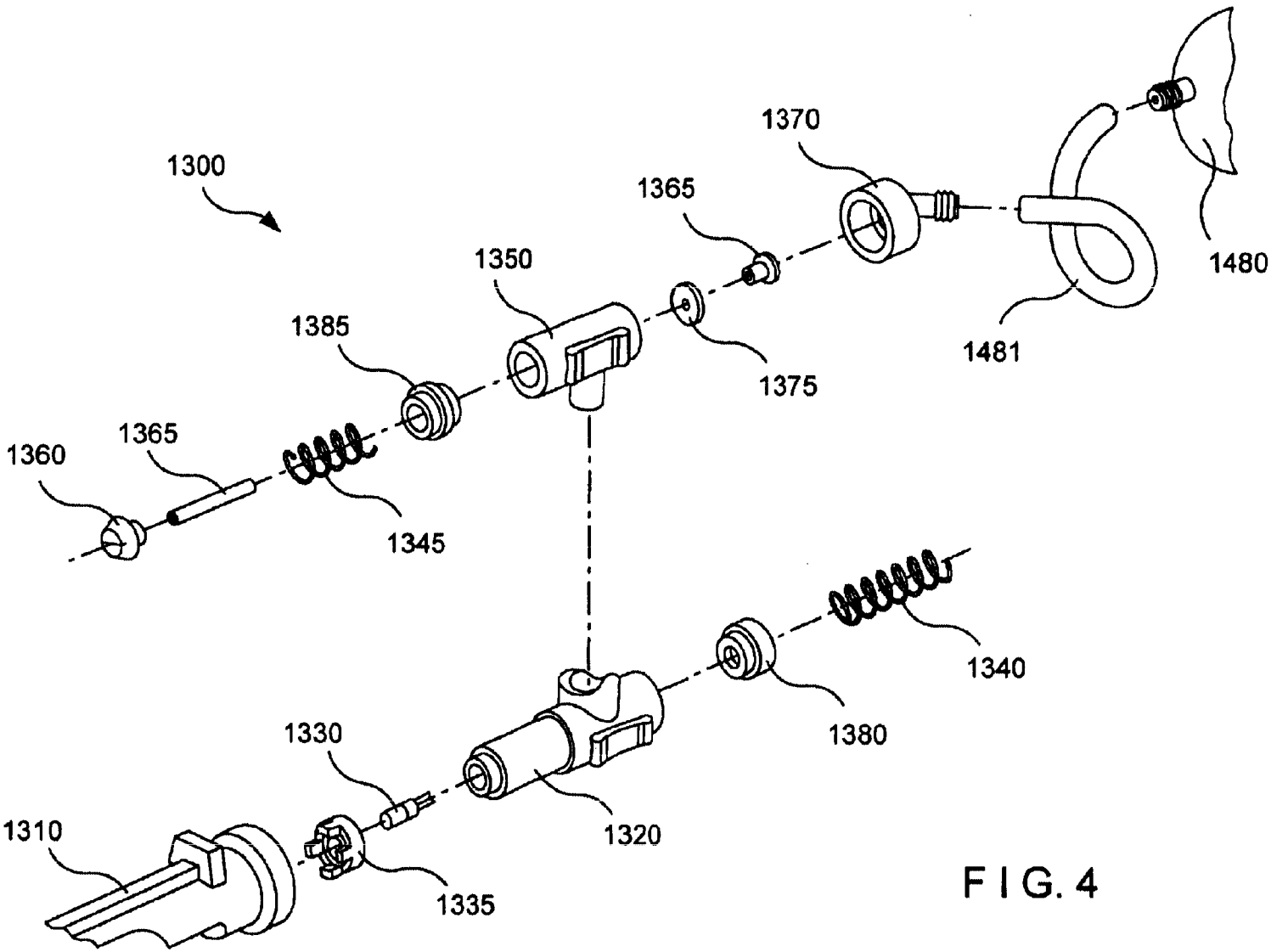
FIG. 4 is an exploded assembly of a firing mechanism for an embodiment of the present invention.

FIG. 4 is an exploded assembly of a firing mechanism 1300 for an embodiment of the present invention. The firing mechanism 1300 comprises a generally cylindrical main pin body 1320 which is where the light source 1330 for illuminating the projectile is housed. In some embodiments the light source 1330 may be omitted. In the embodiment containing the light source 1330, a generally circular shaped cruciform 1335 attaches to the main pin body 1320 to hold the light source in place and allow for substantially total radial illumination of the projectile while the firing pin is entering the projectile. A portion of the light source 1330 extends out from the end of the cruciform 1335 to further enhance exposure of the projectile to light. The cruciform 1335 has openings to allow air from the pressurized tank 1480 to exit the firing mechanism 1300 to launch the projectile 1600. The cruciform 1335 is also a safety device used to prevent objects from being forced into the firing mechanism.

On the other end of the main pin body 1320 is a lower end cover 1380 which holds one end of the main firing spring 1340. Extending from the top of the main pin body 1320 is the generally cylindrically shaped upper valve housing 1350. To the front of the upper valve housing 1350 is a front cover 1385 and a knocker 1360 connected to a knurled valve pin 1365. Surrounding the knurled valve pin 1365 and butting up against the rear of the knocker 1360 and the front of the front cover is the upper valve spring 1345. The upper valve spring 1345 allows for compression and then return of the knocker 1360 following firing of the mechanism. Extending out the rear of the upper valve housing 1350 towards the tank 1480 is a main valve gasket 1375 and a gasket holder 1366. These devices are attached to the knurled valve pin 1365. Connected behind the upper valve housing 1350 is an adapter 1370 for providing an connection between the coiled hose 1481 leading to the tank 1480 and the upper valve housing 1350.

When the upper valve housing 1350 is connected to the main pin body 1320 an open hollow air passage is created but sealed from the pressurized gas in the tank 1480 by the main valve gasket 1375 and gasket holder 1366. When the firing mechanism is actuated and the knocker 1360 hits a static portion of the main body 1100, the knurled valve pin 1365 compresses causing the main valve gasket 1375 and gasket holder 1366 which are attached to the knurled valve pin 1365 to open the airway to the pressurized tank 1480. The pressurized air is then forced through the upper valve housing 1350, into the main pin body 1320 and out the main pin body 1320 and into the projectile 1600 to launch the projectile.

Figure 10:
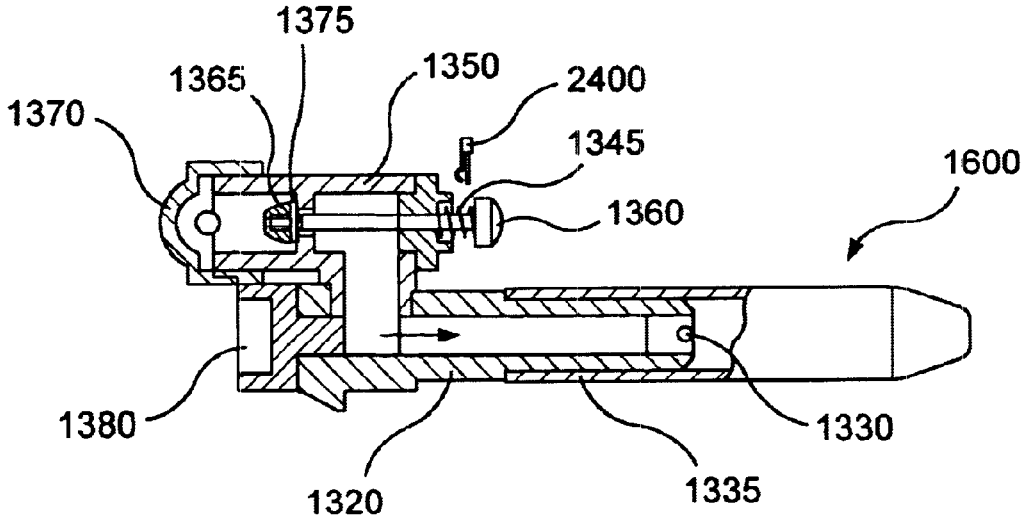
FIG. 10 is a side view of a firing mechanism engaging with a projectile for an embodiment of the present invention.

FIG. 10 is a side view of the firing mechanism depicted in FIG. 4. Similar parts from one figure to another are numbered similarly. In FIG. 10 the main valve gasket 1375 and gasket holder 1365 are butted up against the upper valve housing 1350 due to the force of the upper valve spring 1345. The air chamber in the main pin body 1320 is therefore separated from the air in the tank 1480 and adaptor 1370.

Figure 5:
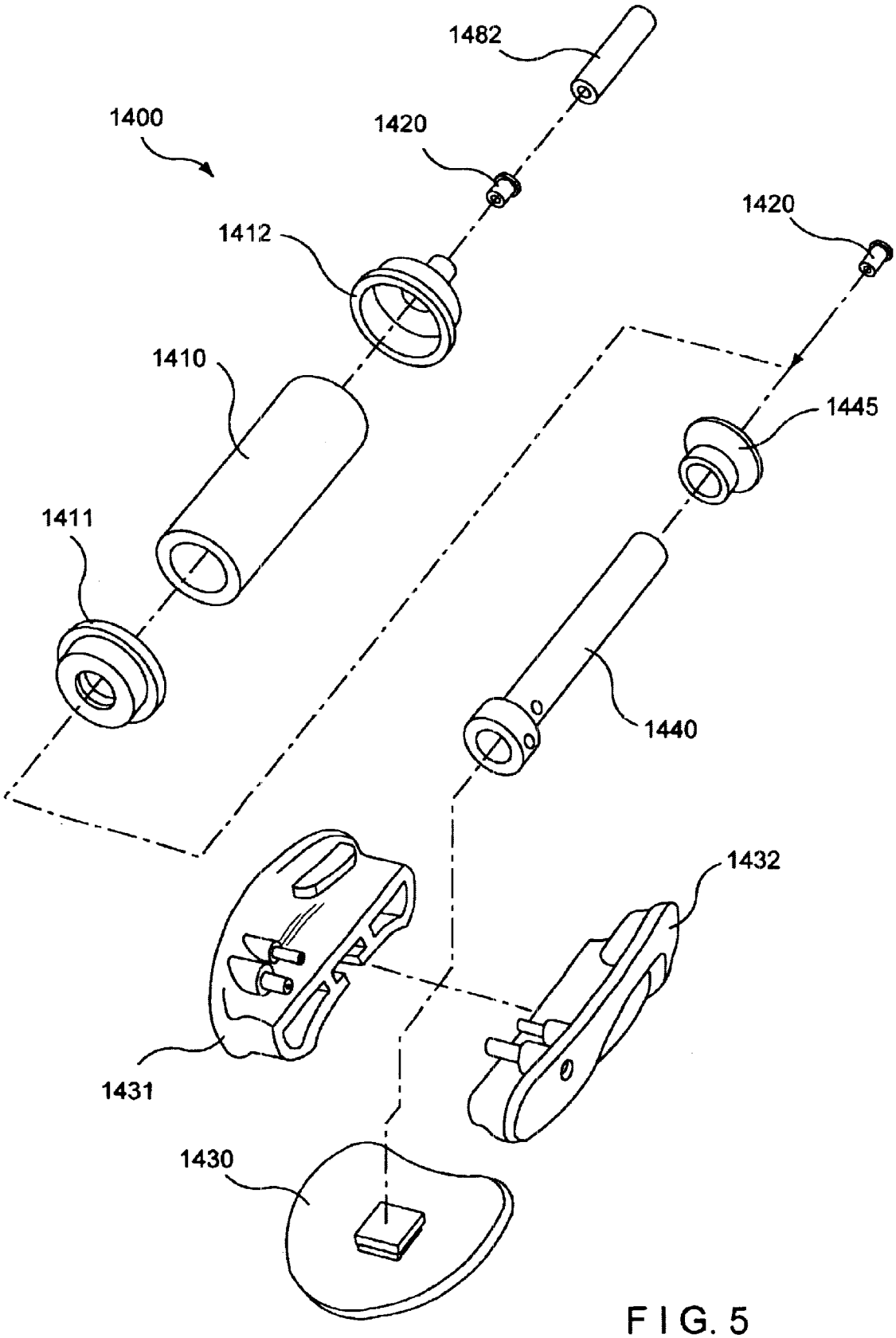
FIG. 5 is an exploded assembly of a pump assembly for an embodiment of the present invention.

FIG. 5 is an exploded assembly of a pump assembly 1400 for an embodiment of the resent invention. The pump assembly 1400 comprises a pump body 1410 with a bottom pump cover 1411 and a top pump cover 1412 connected to a one-way valve assembly 1420 and a hose 1482 leading to tank 1480. Inside the pump body 1410 is a pump squeegee 1445 attached to a pump arm 1440. The pump arm 1440 attaches to the pump handle 1430. The pump handle 1430 also has side handle supports, the right pump handle 1431 and the left pump handle 1432 which help in providing leverage to move the pump arm 1440. Attached to the pump arm 1440 and the pump squeegee 1445 is a pressure release valve 1450.

Figure 6:
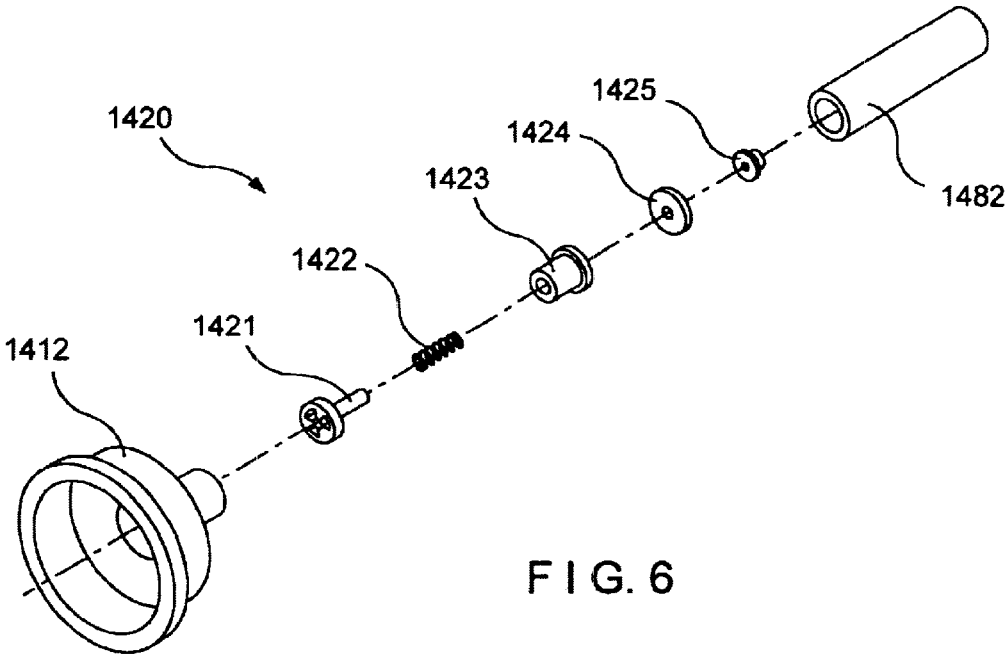
FIG. 6 is an exploded assembly of the one-way tank valve assembly depicted in FIG. 5.

FIG. 6 is an exploded assembly of the one-way tank valve assembly 1420 depicted in the one-way valve assembly 1420 provides for the air in the pump body 1410 to be forced into the tank 1480 through compression of the pump squeegee 1445, but the air would not be able to return in to the pump body 1410 when the pump arm 1440 pulls back. The one-way valve assembly 1420 comprises a guide arm 1421 with openings to allow air to pass though and a spring valve 1422 which are both inserted in to a one-way valve cover 1423. The shaft of the guide arm 1421 extends through the one-way valve cover 1423 and attaches to a retaining cap 1425. A gasket 1424 separates the retaining cap 1425 from the one-way valve cover 1423. In the resting position, the pressure in the tank 1480 and connecting hose 1482 forces the retaining cap 1425 against the gasket 1424 which is against the one-way valve cover 1423. The opening through the one-way valve cover 1423 is therefore sealed and air cannot escape the tank 1480 and return into the pump body 1410. When the pump arm 1440 compresses air from the pump body 1410 the guide arm 1421 is forced against the one-way valve cover 1423, forcing the retaining cap 1425 to move away from the one-way valve cover 1423. The openings in the guide arm 1421 allow air to pass through the one-way valve cover 1423 and into the tank 1480.

Figure 7:
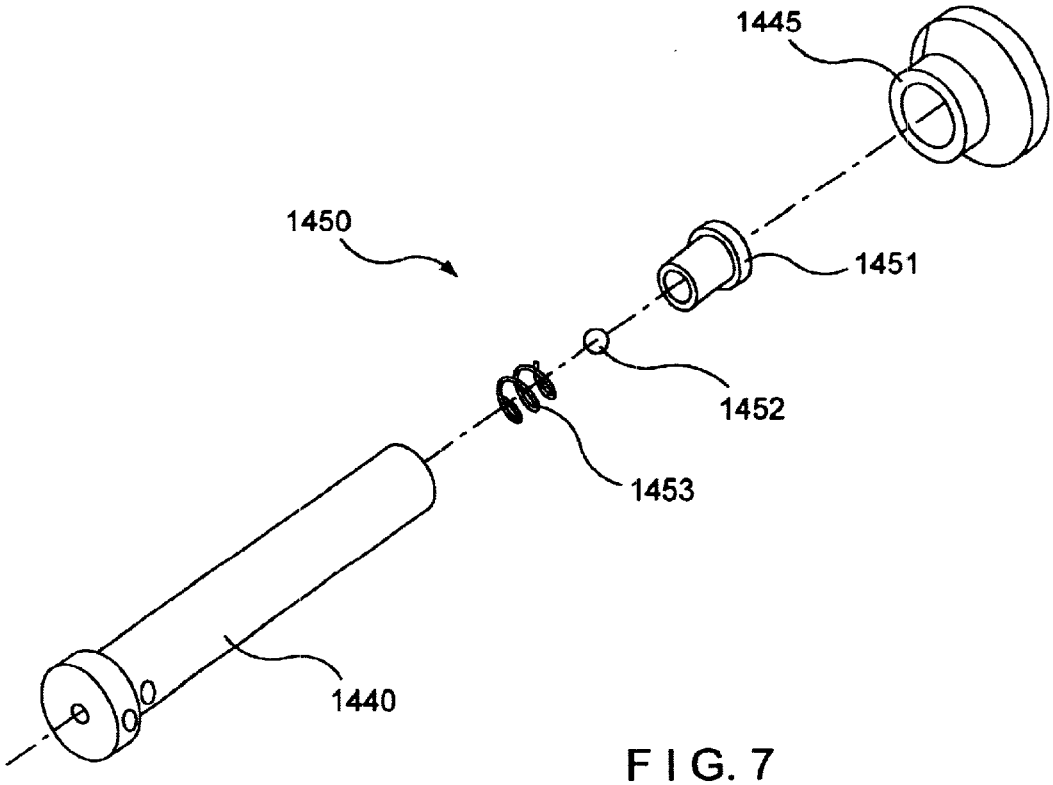
FIG. 7 is an exploded assembly of the purge valve assembly depicted in FIG. 5.

FIG. 7 is an exploded assembly of the purge valve assembly 1450 depicted in FIG. 5. The purge valve assembly 1450 is a safety feature that operates as a pressure release valve to prevent the tank 1480 from over pressurizing. The purge valve cover 1451 is attached to the inside of the pump squeegee 1445 and pump arm 1440. The purge valve cover forms a generally cylindrical shape with an opening large enough to house a conical spring 1453 and a ball bearing 1452. The ball bearing 1452 in the resting position butts up against the top opening of the purge valve cover 1451 from the force of the conical spring 1453. However, when the pressure in the tank reaches a critically high pressure, in one embodiment that pressure is 40–50 psi, the force of the air pressure in the tank 1480 will force the ball bearing 1452 against the force of the spring 1453 and will allow air from the tank 1480 to be released in order to lower the pressure within the tank 1480 until the force of the spring 1453 forces the ball 1452 against the opening of the purge valve cover 1451.

Other one-way valves systems and purge valve systems known in the art may be used to accomplish the same functions as described by the valve system of this embodiment.

Figure 16:
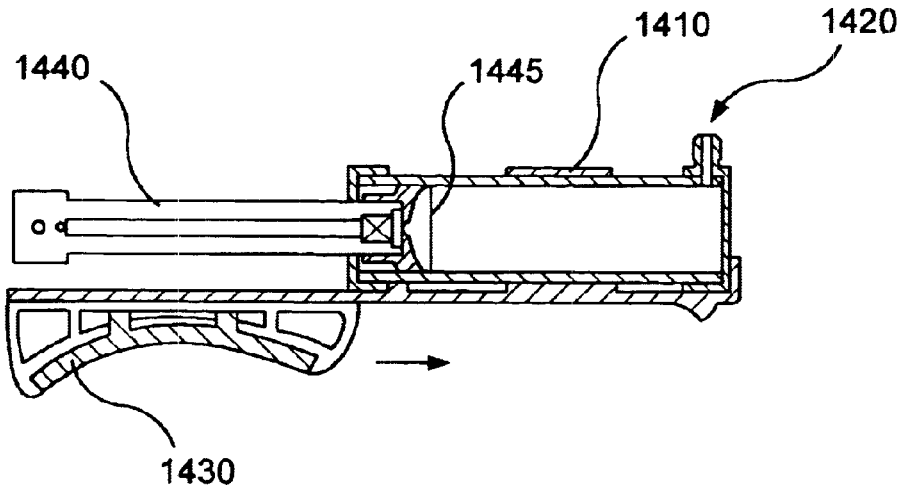
FIG. 16 is a side view of the pump mechanism as depicted in FIG. 5 in the resting position.
Figure 17:
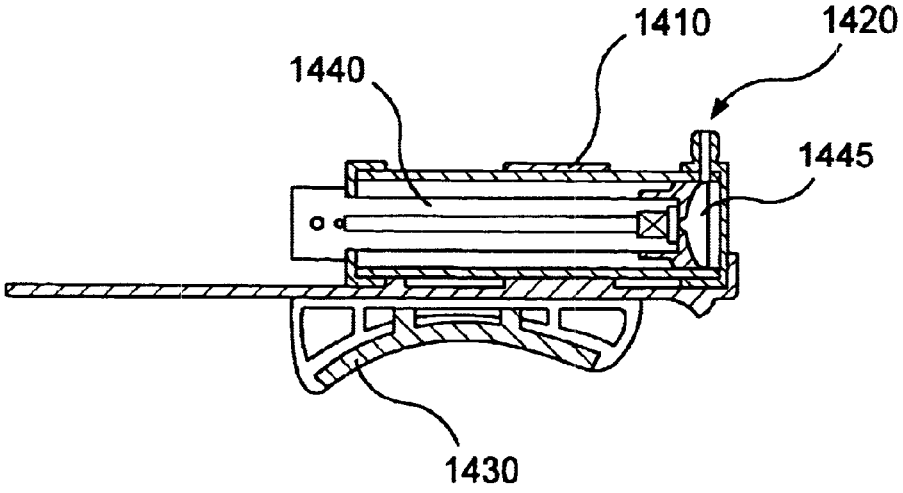
FIG. 17 is a side view of the pump mechanism as depicted in FIG. 5 in the compressed position

The operation of the pump 1400 is depicted in FIG. 16 where the pump mechanism 1400 is in a resting position and FIG. 17 where the pump mechanism 1400 is in the compressed position. In the resting position, the pump arm 1440 is pulled out of the pump body 1410 and the squeegee 1445 is at the furthest position within the pump body 1410. In the compressed position, the pump arm 1440 is pushed into the pump body 1410 causing the pump squeegee 1445 to push air through the one-way valve 1420 of the pump body 1410 and into the hose 1482 leading to the tank 1480. When the pump arm 1440 is retracted to the rest position, the one-way valve 1420 does not allow air to be removed from the tank 1480 and back into the pump body 1410.

Figure 22:
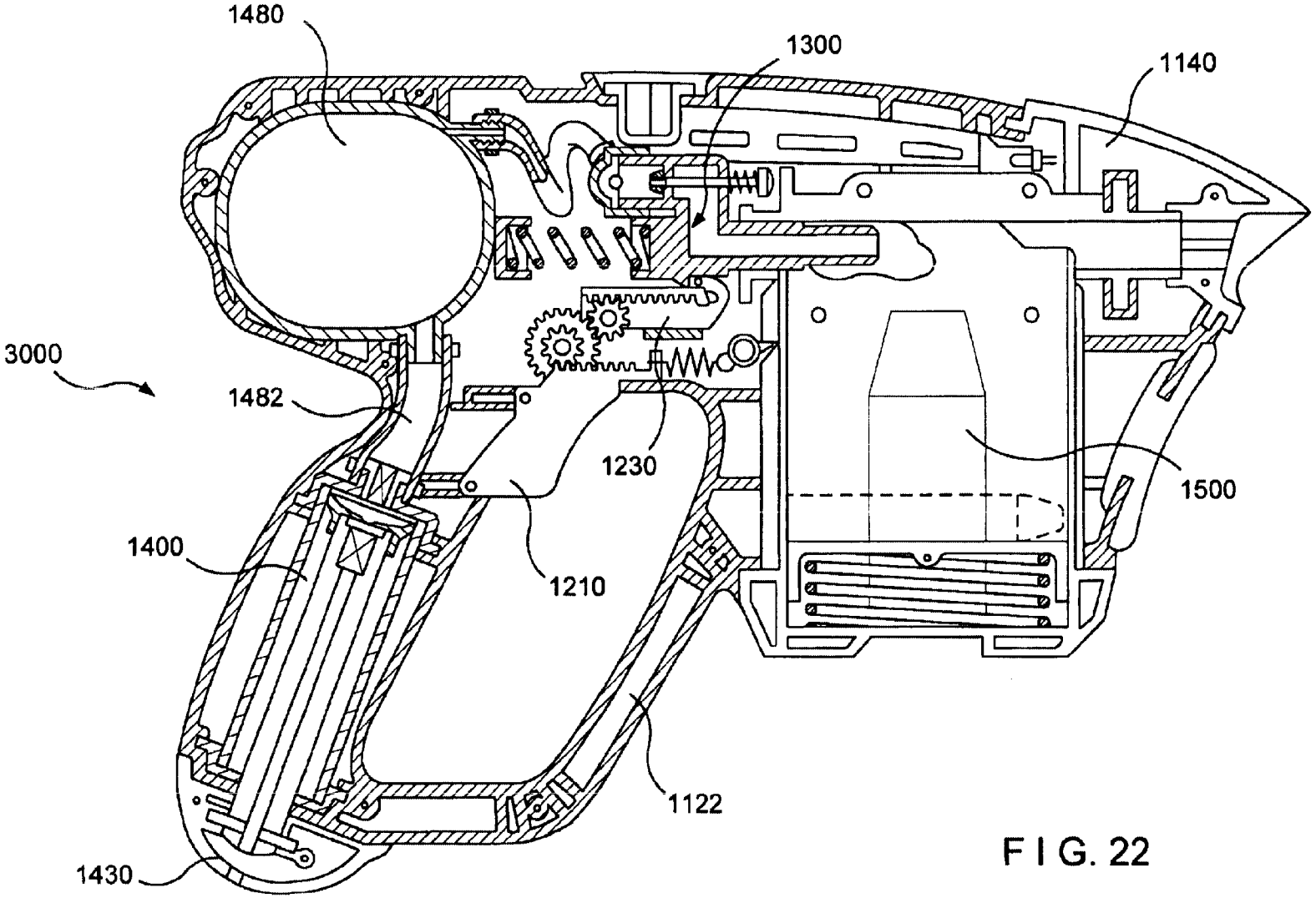
FIG. 22 is a side view of an embodiment of the present invention, with portions in sections and portions broken away, and with the pump device located in the handle portion of the gun.
Figure 23:
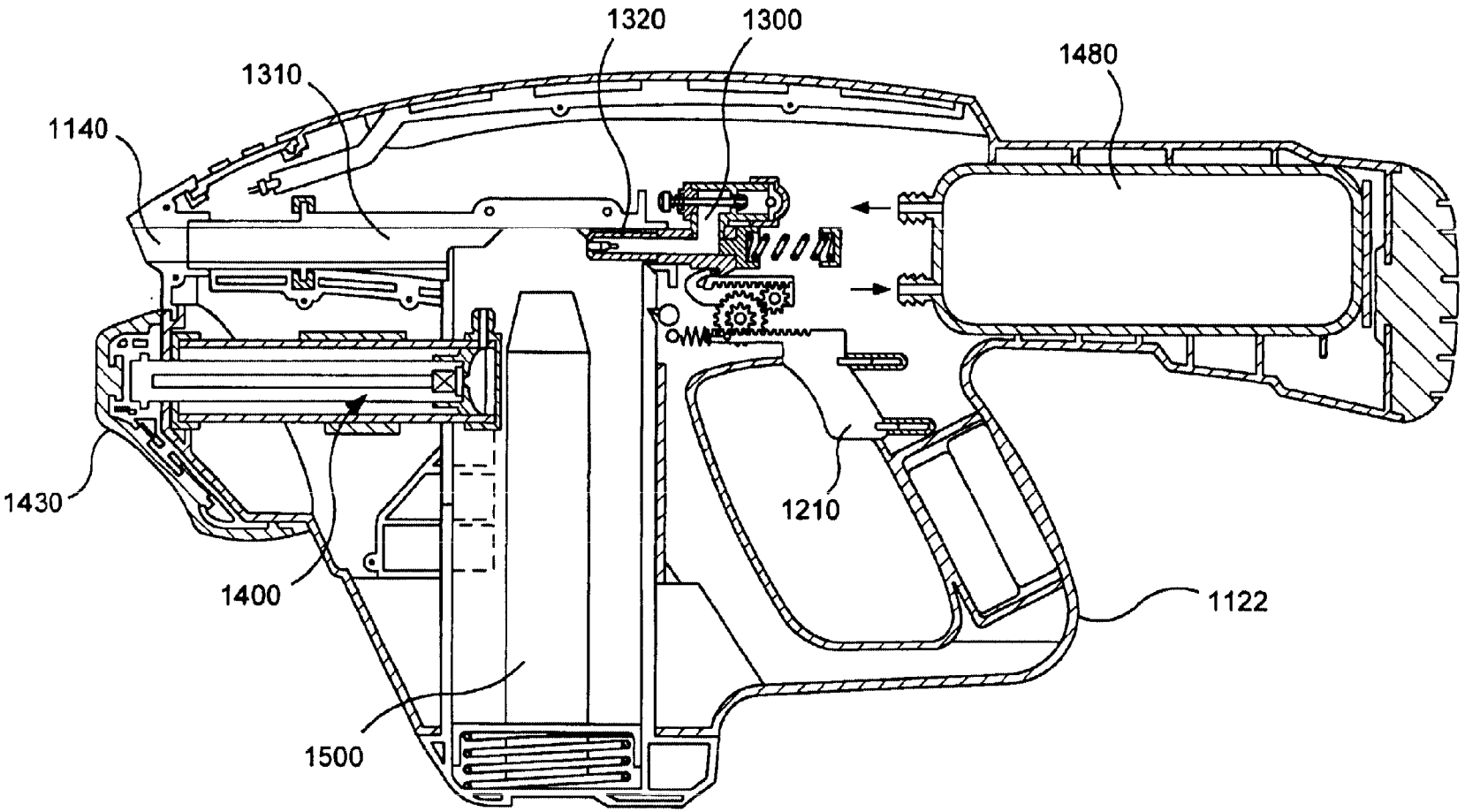
FIG. 23 is a side view of an embodiment of the present invention, with portions in sections and portions broken away, and with the pump device located in the front portion of the gun.

The pump system of the present invention may comprise any known pumping system known in the art to achieve the function of providing pressurized air for launching projectiles. The pump system may be located in various positions in the launcher and may comprise various shapes and configurations. FIG. 22 shows another embodiment of the present invention where the pumping mechanism is located in the handle portion 1122 of the gun and the pump handle 1430 extends downward from the gun. FIG. 23 is another embodiment of the present invention where the pumping mechanism is located in the front of the gun below the barrel 1310. The pump handle 1430 extends forward out the gun in the direction of the line of fire.

Figure 8:
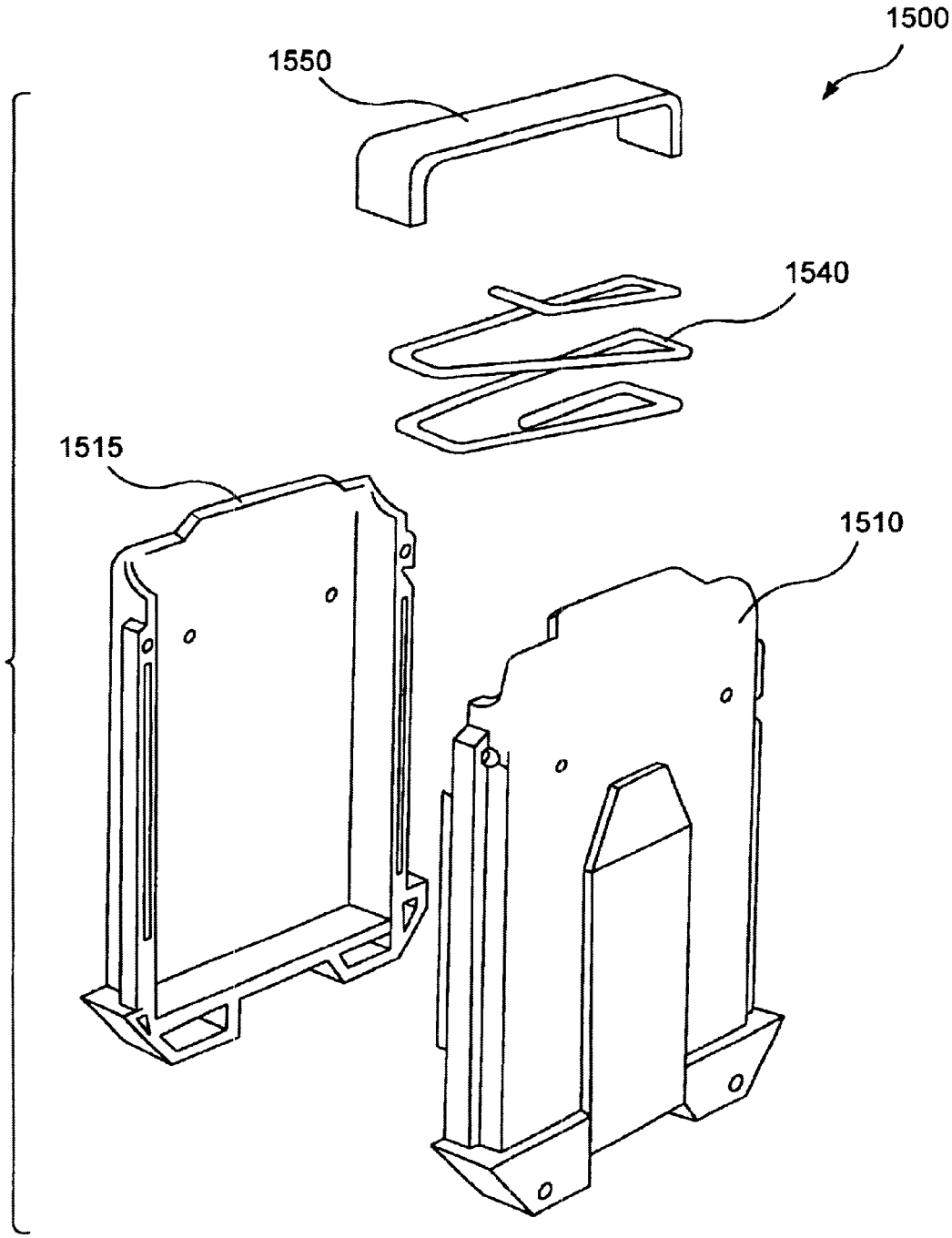
FIG. 8 is an exploded assembly of a clip assembly for an embodiment of the present invention.

FIG. 8 is an exploded assembly of a clip assembly 1500 for an embodiment of the present invention. The clip assembly 1500 comprises a left clip housing 1510 and a right clip housing 1515 for housing projectiles 1600. The top of the clip forms a rounded opening so that the firing pin can enter the clip assembly 1500 to fire a projectile. Within the clip housing is a clip spring 1540 and on top of the clip spring 1540 is a clip insert 1550. The clip insert 1550 allows for a place for the projectile to rest without having to rest on the spring itself. In operation the clip spring 1540 is compressed when the clip is filled with projectiles and as each projectile 1600 is fired the spring 1540 forces the projectiles 1600 towards the top of the clip housing.

Figure 9:
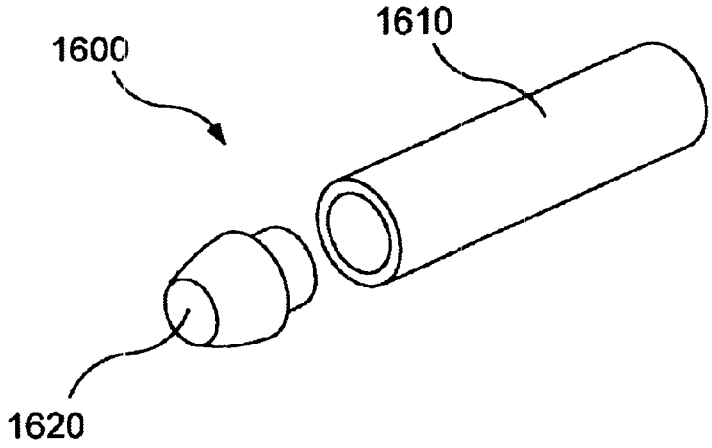
FIG. 9 is an embodiment of a projectile for the present invention.

FIG. 9 is a perspective view of a projectile 1600 for an embodiment of the present invention. The projectile generally comprises a body portion 1610 and a head portion 1620. The body portion 1610 may be hollow in shape and form a generally cylindrical structure. The head portion 1620 may be formed of a foam material to allow for deformation when the projectile 1600 hits an object. The projectile 1600 may be constructed of any material known in the art for constructing projectiles. The projectile 1600 may contain phosphorescent-activating material to allow the projectile 1600 to glow in the dark. In one embodiment of the projectile, a bulk of the weight of the projectile 1600 is placed near the tip of the projectile to prevent the projectile 1600 from tumbling in flight, but other embodiments may be designed to tumble.

FIG. 10 is a side view of a firing mechanism engaging with a projectile for an embodiment of the present invention. In this embodiment the generally cylindrical portion of the main pin body 1320 comprises a central longitudinal axis. The generally cylindrical hollow portion of the projectile body 1610 also comprises a central longitudinal axis. Both central longitudinal axes align prior to firing, so that the main pin body 1320 can enter into the hollow projectile body 1610 prior to the projectile being fired. In one embodiment, while the pin body 1320 is entering the projectile body 1320, the light source 1330 may be activated by the firing mechanism 1300 closing switch 2400 to expose the phosphorescent-activating portions of the projectile 1600 to radiation, including the inside surface of the projectile body. The relative position of light source 1330, firing mechanism 1300, and projectile 1600, e.g., positioning the light source within the projectile and relative to the firing mechanism so that it illuminates or actuates all or a substantial portion of the inside cylindrical wall of the projectile or the phosphorescent-activating portions of the projectile, leads to optimal and/or uniform glow so that when the projectile 1600 is launched from the gun, it will glow in the dark.

Figures 11A, 11B, 11C, 11D:
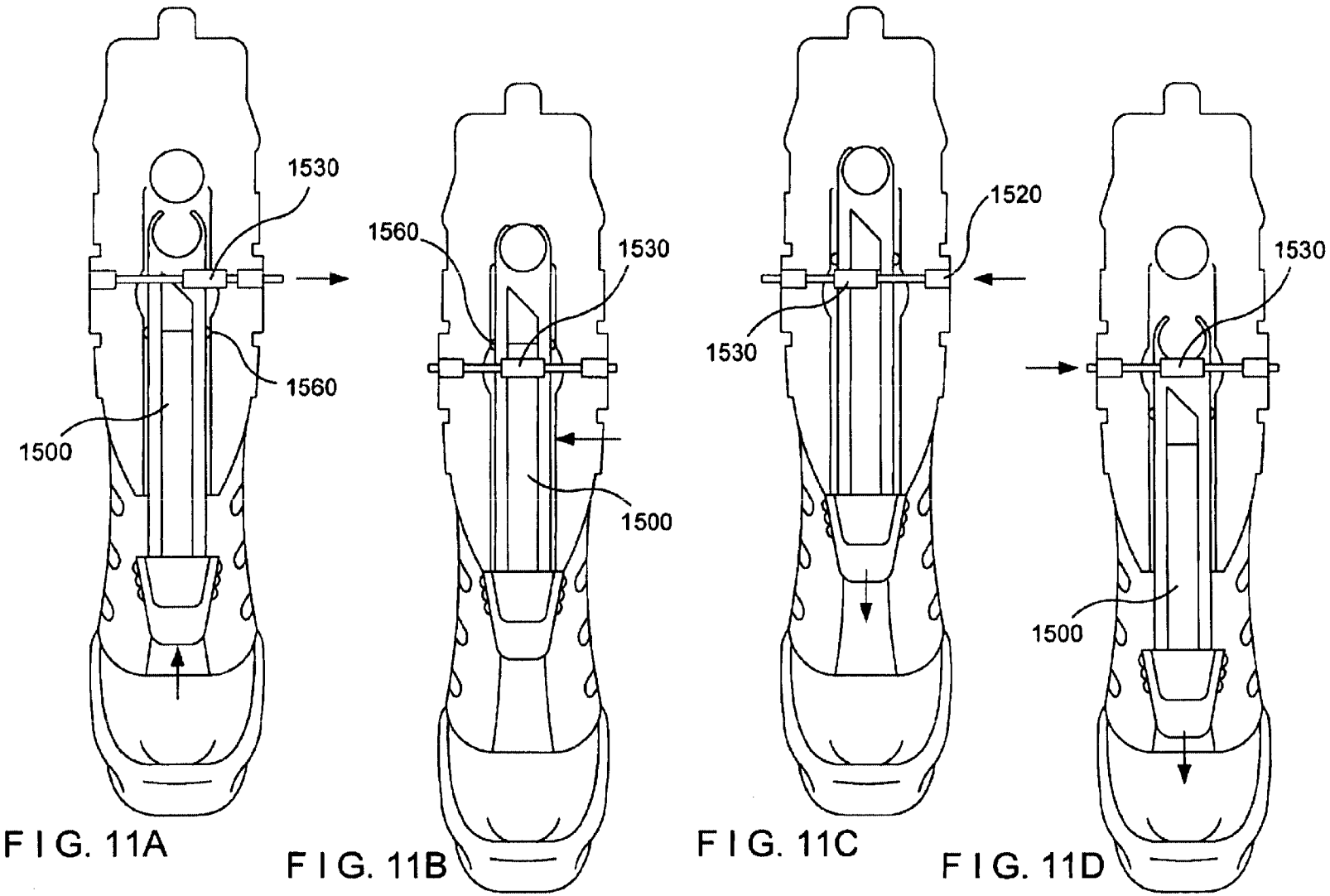
FIGS. 11A–D, depicts a clip release mechanism for an embodiment of the present invention.

FIG. 11 including FIGS. 11A, 11B, 11C and 11D, is a section view of the clip release mechanism for an embodiment of the present invention. FIG. 11A depicts the clip 1500 being inserted into the gun. The clip has friction bumps 1560 which guide and bind the clip into the inner wall of the gun to hold the clip in place. Upon insertion, the clip release arm 1530 slides out of the way. Once the clip 1500 is inserted, the clip release arm 1530 returns to a resting position as shown in FIG. 11B to lock the clip in place. To remove the clip, as depicted in FIG. 11C, the user pushes on the release buttons 1520 on the exterior of the gun's body 1100 to move the release arm 1530. The friction bumps 1560 will hit a loose section in the track to allow the clip 1500 to fall a short distance so the user can pull the clip out of the gun. After the clip 1500 is removed, the release arm 1530 returns to a resting position as shown in FIG. 11D. Various other locking mechanism may be used for holding and releasing the clip from the toy body.

Figure 12:
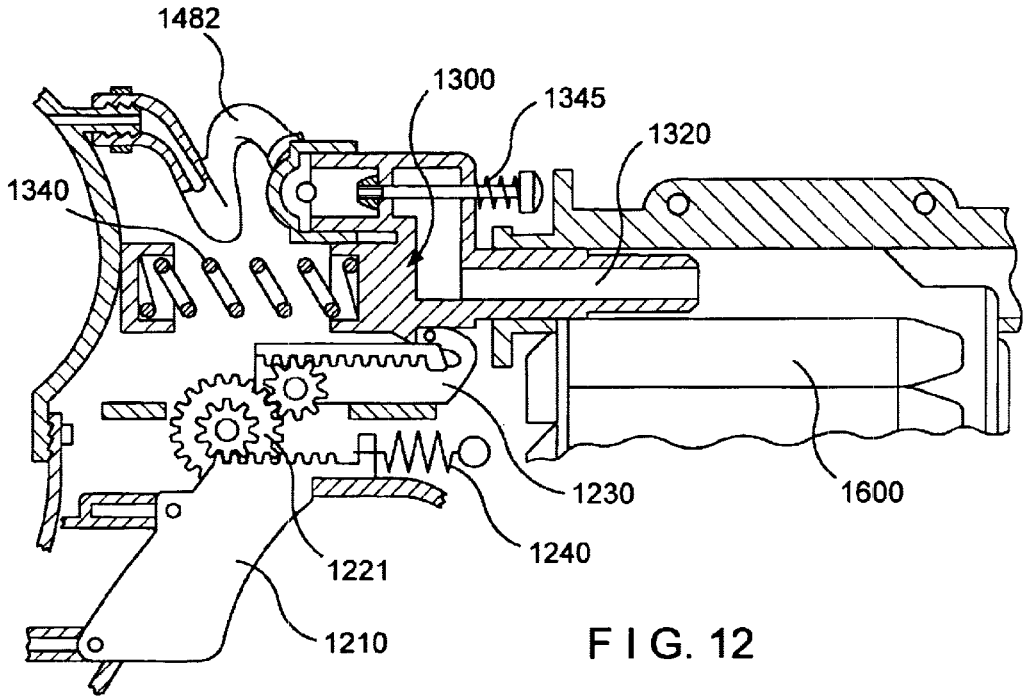
FIG. 12 is a side view of the trigger mechanism as depicted in FIG. 3 in a resting position with portions in sections and portions broken away.
Figure 13:
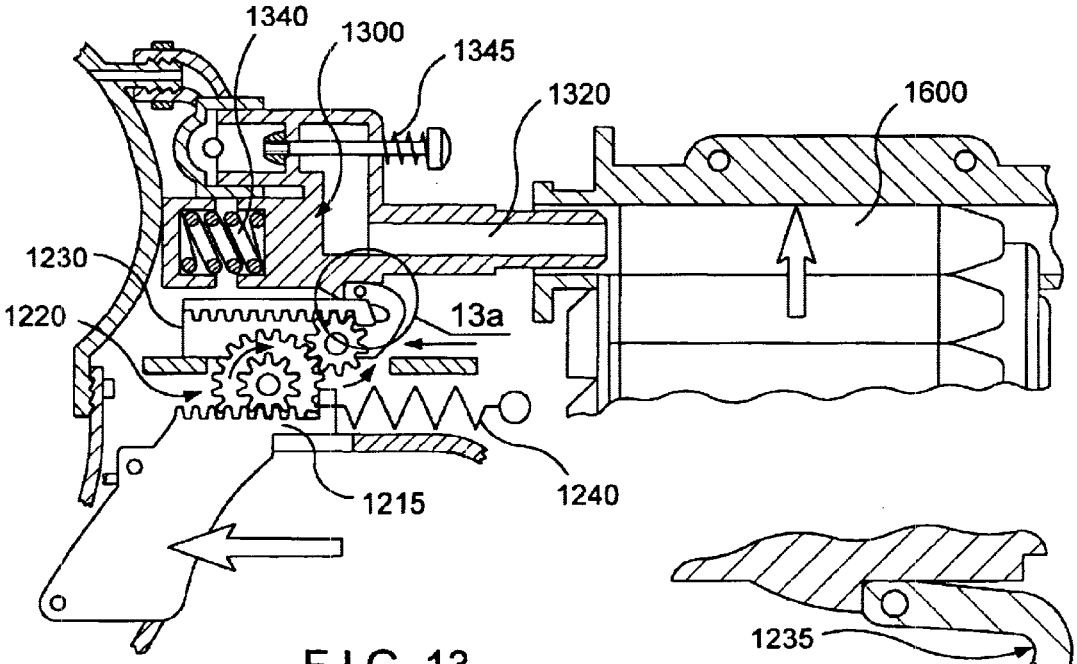
FIG. 13 is a side view of the trigger mechanism as depicted in FIG. 3 with portions in sections and portions broken away, when the user initially pulls the trigger.
Figure 13A:
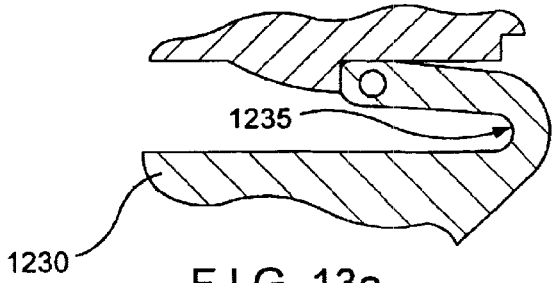

FIGS. 12, 13, 14, and 15 depict the positioning of the mechanisms within the launcher during the firing sequence. FIG. 12 is a side view of the trigger mechanism as depicted in FIG. 3 in a resting position. In this position, all of the springs 1340, 1240, 1345 are in the resting position. When the user initially pulls back the trigger 1210, as shown in FIG. 13 the trigger arm 1215 causes the gear assembly 1220 to rotate which in turn causes the drawing pin 1230 to move back. On one end of the drawing pin 1230 is a living hinge 1235 which interconnects with the main pin body 1320 to begin to pull the firing mechanism 1300 back. With the main pin body 1320 completely pulled out of the clip 1500, under urging of the clip spring 1540, the next projectile 1600 advances.

Figure 14:
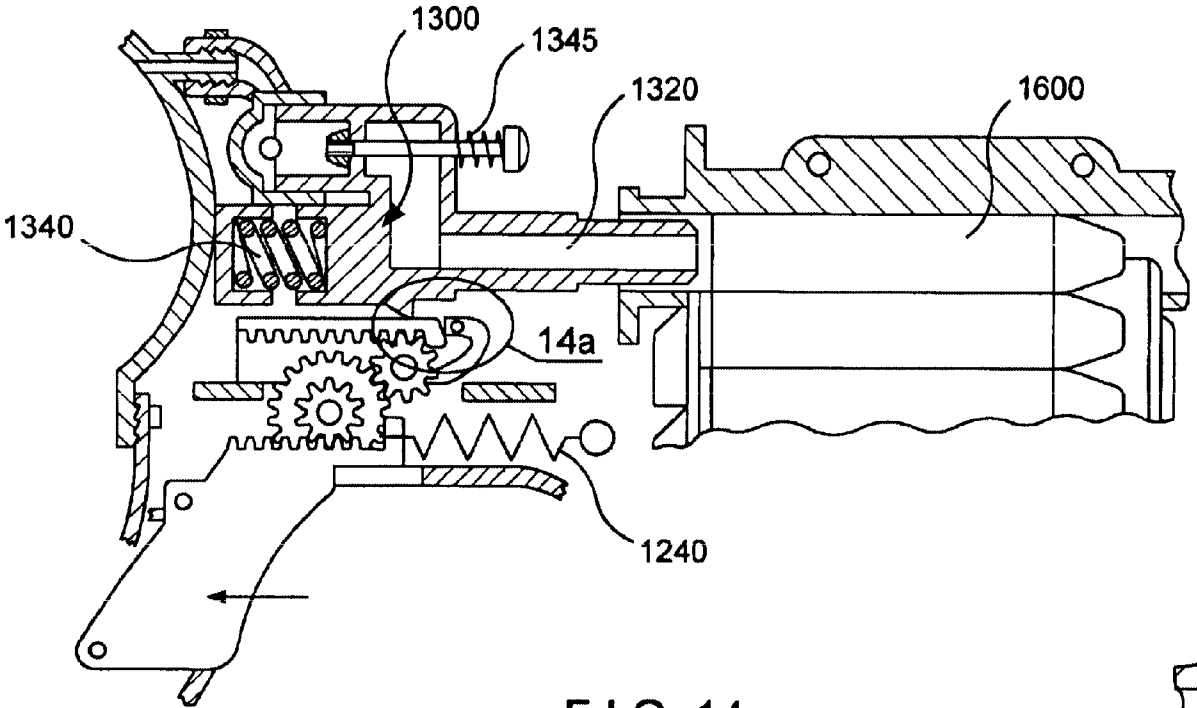
FIG. 14 is a side view of the trigger mechanism as depicted in FIG. 3 when the trigger reaches its farthest point backwards with portions in sections and portions broken away.
Figure 14A:
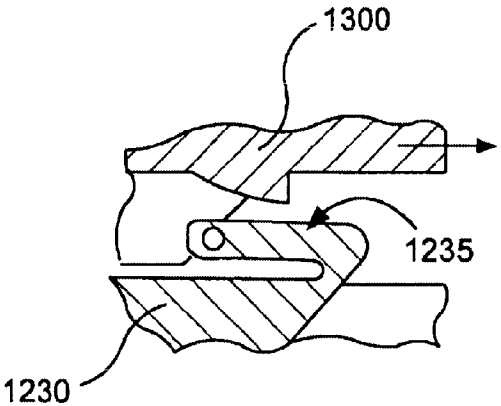
Figure 15:
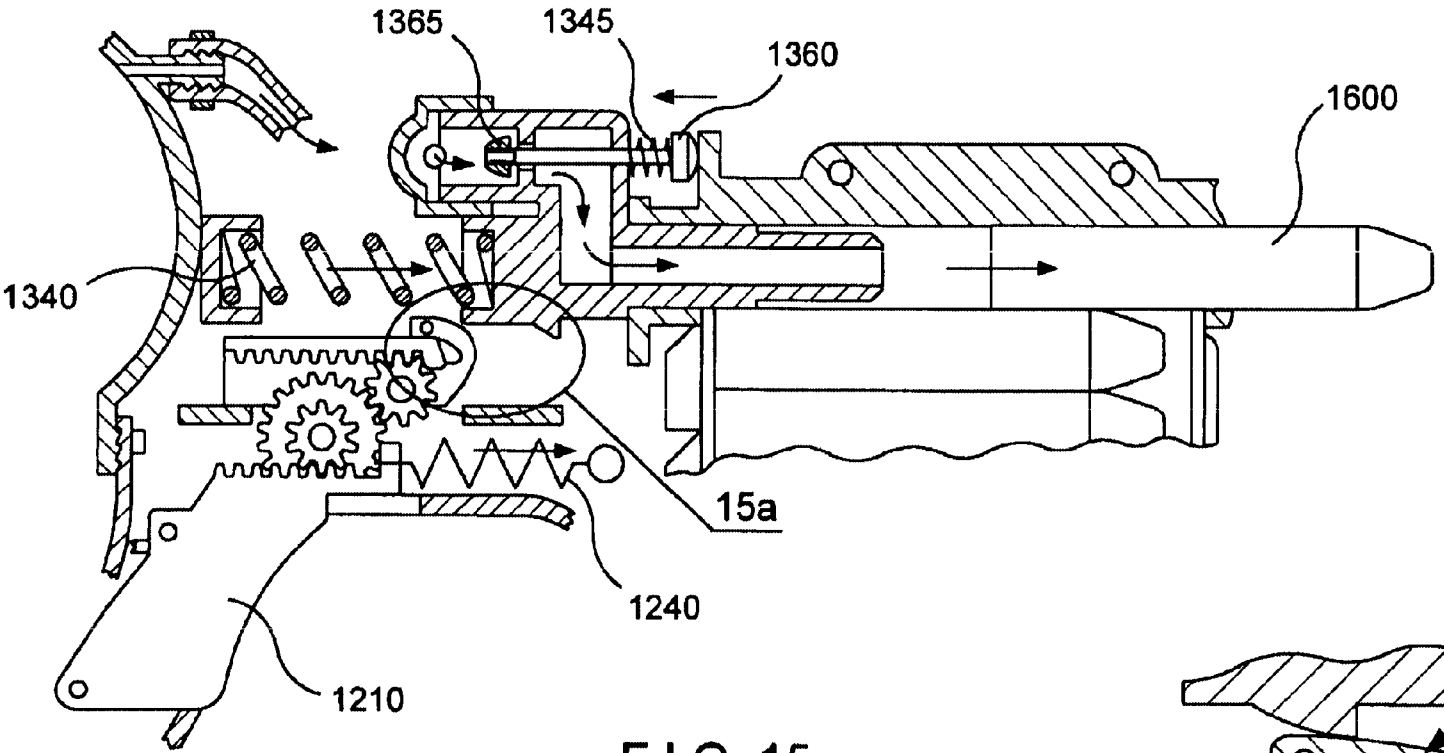
FIG. 15 is a side view of the trigger mechanism as depicted in FIG. 3 when the firing mechanism springs forward with portions in sections and portions broken away.
Figure 15A:
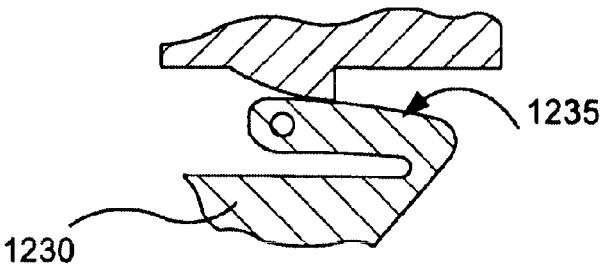

FIG. 14 is a side view of the trigger mechanism as depicted in FIG. 3 when the trigger reaches its farthest point backwards. When the trigger 1210 reaches its farthest point backwards, the living hinge 1235 is hinged far enough to cause the firing mechanism 1300 to release and spring forward as depicted in FIG. 15. When the firing mechanism 1300 springs forward, the main body of the firing pin 1320 enters into the projectile as shown in FIG. 10. The firing mechanism 1300 continues to extend forward and the knocker 1360 hits the static wall of the gun body 1100. The knocker 1360 connected to the knurled valve pin 1365 is forced back and compressed air from the tank 1480 travels through hose 1481 into the upper valve housing 1350 and out through the main pin body 1320 to launch the projectile 1600 out of the clip 1500. After leaving the clip 1500 the projectile 1600 passes through the barrel 1310 and out the nose cone 1140, exiting the gun. Following the firing of the mechanism, the expansion spring 1240 causes trigger mechanism returns to the resting position as shown in FIG. 12.

Other embodiments of the interaction of a trigger mechanism along with a firing mechanism to launch a projectile from the gun are within the scope of this invention. The size and positioning of the various mechanisms of the present embodiment may be varied to allow for different embodiments of the present invention. For example, a larger or smaller size tank, longer trigger arm, a different gear system, or other launching mechanism are within the scope of the present invention.

Figure 18:
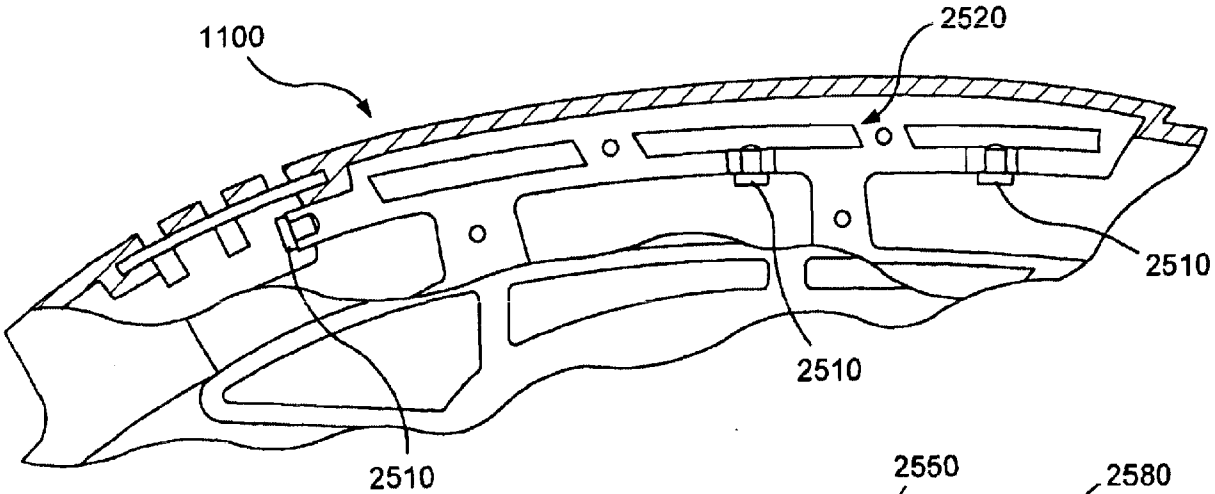
FIG. 18 is a side view of a portion of the surface of an illuminated embodiment of the invention.

FIG. 18 is a side view of the surface of the an embodiment of the invention that illuminates. The toy of the present invention may be equipped with surface lights 2510 that illuminate through light plates 2520 that are attached to the main body 1100 of the gun. When the surface lights 2510 are activated, they cause the light to project through the light plates 2520 and cause the toy to light up. These lights may be placed in various positions on the gun or may be connected in any form to cause the lights to flash, blink, or chase and in any other way illuminate. The surface lights may be activated through the trigger mechanism contacting a switch.

Figure 19:
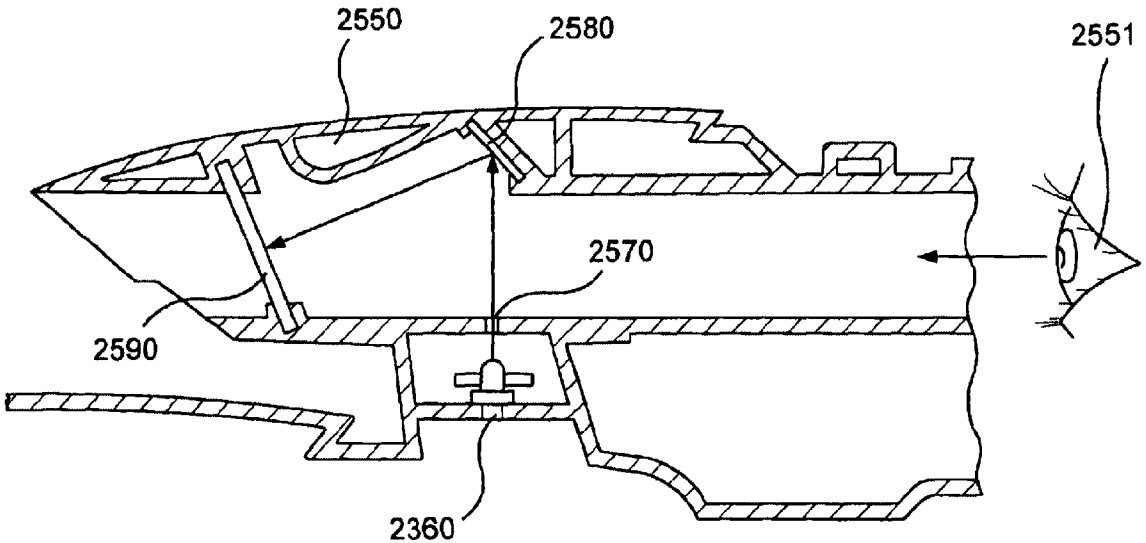
FIG. 19 is a side view of a scope assembly for an embodiment of the present invention.

FIG. 19 is a side view of the scope assembly for an embodiment of the present invention. The scope 2550 may have a clear lens 2590 or a magnifying lens 2590 to make objects appear closer. In another embodiment, a light emitting diode 2560 of any visible color could be located in the body and, when activated, emit light through a pinhole 2570. The light could then be reflected off of a reflecting surface 2580, oriented so as to reflect the emitted light to a specific point on the lens 2590 located at the opposite end of the scope as a user's eye 2551. This could give the user a view through the scope of a target with a small red dot projected onto it, thus giving the illusion of "laser targeting. The light emitting diode 2560 may be actuated by the trigger mechanism so that the light appears before the projectile is fired.

Figure 20:
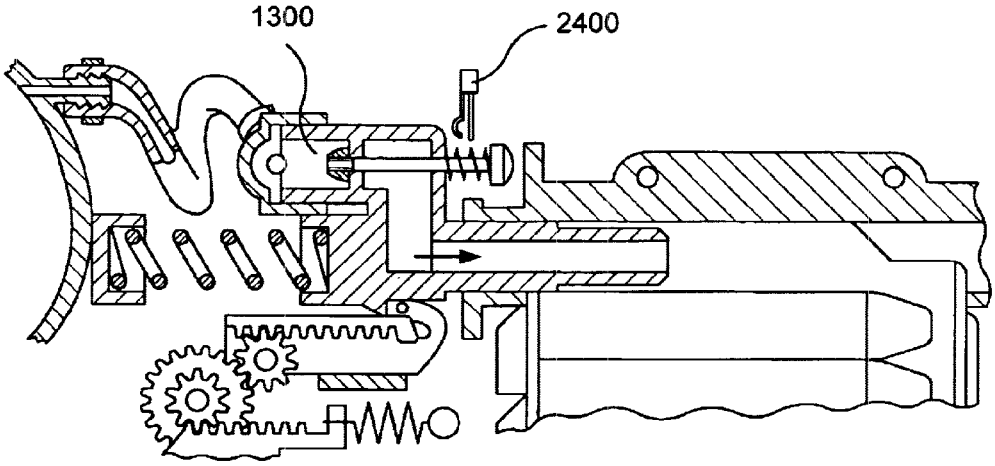
FIG. 20 is a side view of a switch activated by the firing mechanism for an embodiment of the present invention.

FIG. 20 is a side view of a switch activated by the firing mechanism 1300 for an embodiment of the present invention. Light switch 2400 is positioned so that the firing mechanism controls it to move it to activate a light source 1330 when the firing mechanism 1300 is fired forward. Light switch 2400 may also act to activate the surface lights 2510. Other switch mechanisms may be used so that the projectile is exposed to radiation prior to being fired from the launcher.

Figure 21:
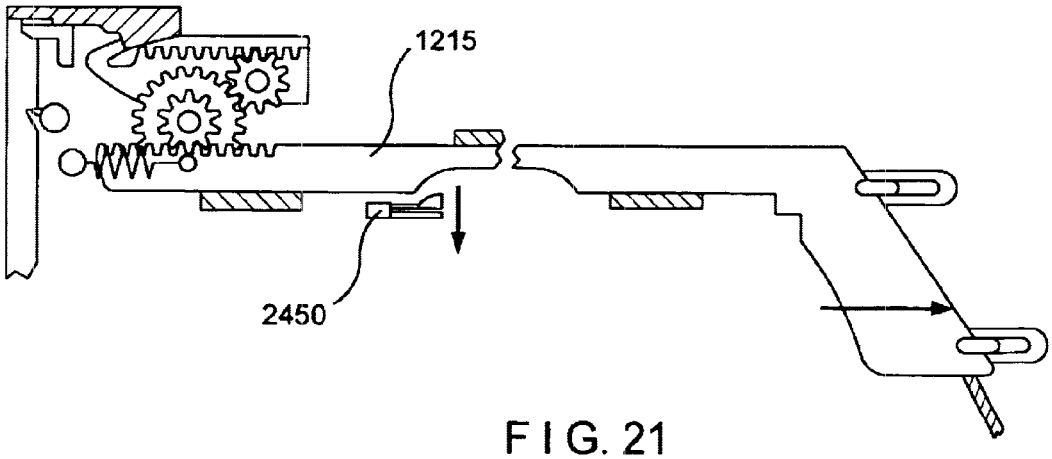
FIG. 21 is a side view of a switch activated by the trigger mechanism for an embodiment of the present invention.

FIG. 21 is a side view of a switch activated by the trigger mechanism for an embodiment of the present invention. This scope switch 2450 is activated when the trigger 1210 is pulled back causing the trigger arm 1215 to close the scope switch 2450. The scope switch causes the light emitting diode 2560 in the scope to illuminate.

Figure 24:
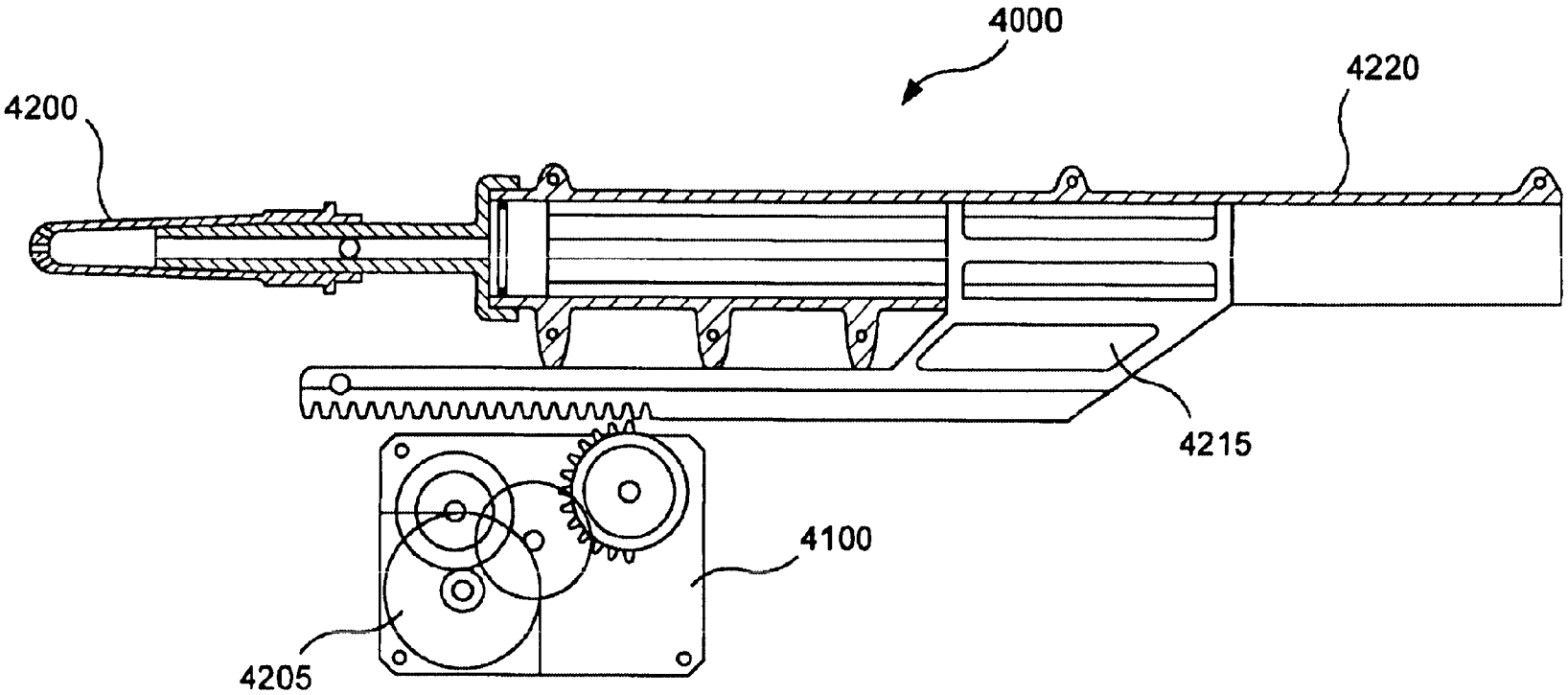
FIG. 24 is a side view of an embodiment of the present invention having a motorized firing mechanism

Other firing mechanisms are with in the scope of the present invention. FIG. 24 an embodiment of another type of firing mechanism having a motorized firing mechanism. The motorized firing mechanism 4000 generally comprises a motor 4205, a gear box 4100, a plunger arm 4215, a pump housing 4220, and a firing pin 4200.

Figure 25:
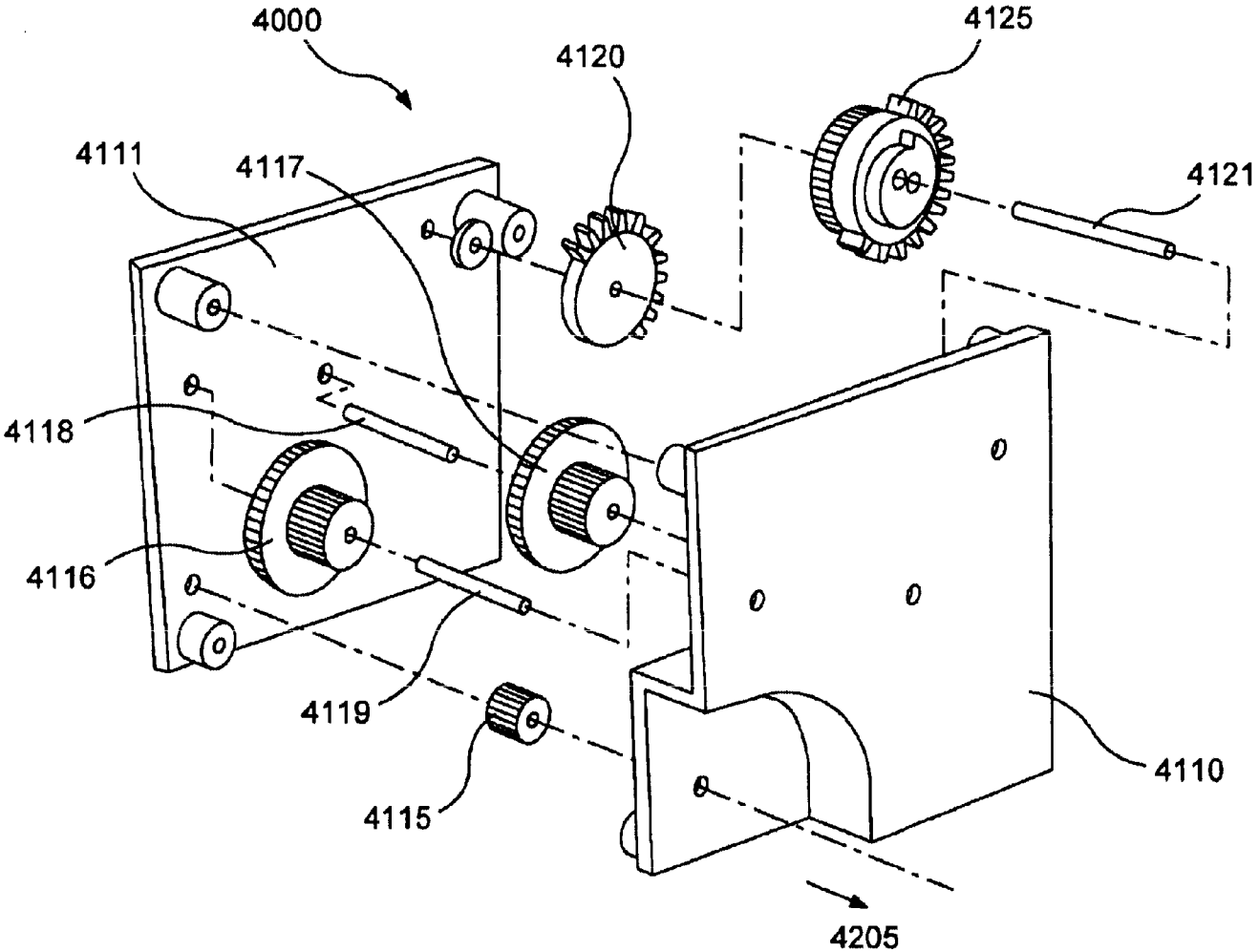
FIG. 25 is an exploded assembly of an embodiment of a gear box for operating the firing mechanism as depicted in FIG. 24.

FIG. 25 is an exploded assembly of an embodiment of a gear box 4100 for operating the motorized firing mechanism 4000 depicted in FIG. 24. The gear box 4100 body comprises two sides: a gear box left plate 4110 and a gear box right plate 4111. Within the gear box are various gears for transferring the movement from the motor 4205 to the firing pin 4200 and the plunger arm 4215. The gear system may comprise an initial gear 4115, an initial transfer gear 4116, a second transfer gear 4117, a firing pin linkage gear 4120 to connect with the firing pin assembly 4200 and a main drive gear 4125 to connect with the plunger arm 4215. A metal shaft 4119 can be used for mounting the initial transfer gear 4116, a metal shaft 4118 for mounting the second transfer gear 4117 and a metal shaft 4121 for mounting the main drive gear 4125. Various types of gear and shaft arrangements could be used to accomplish the function as described in this embodiment.

Figure 26:
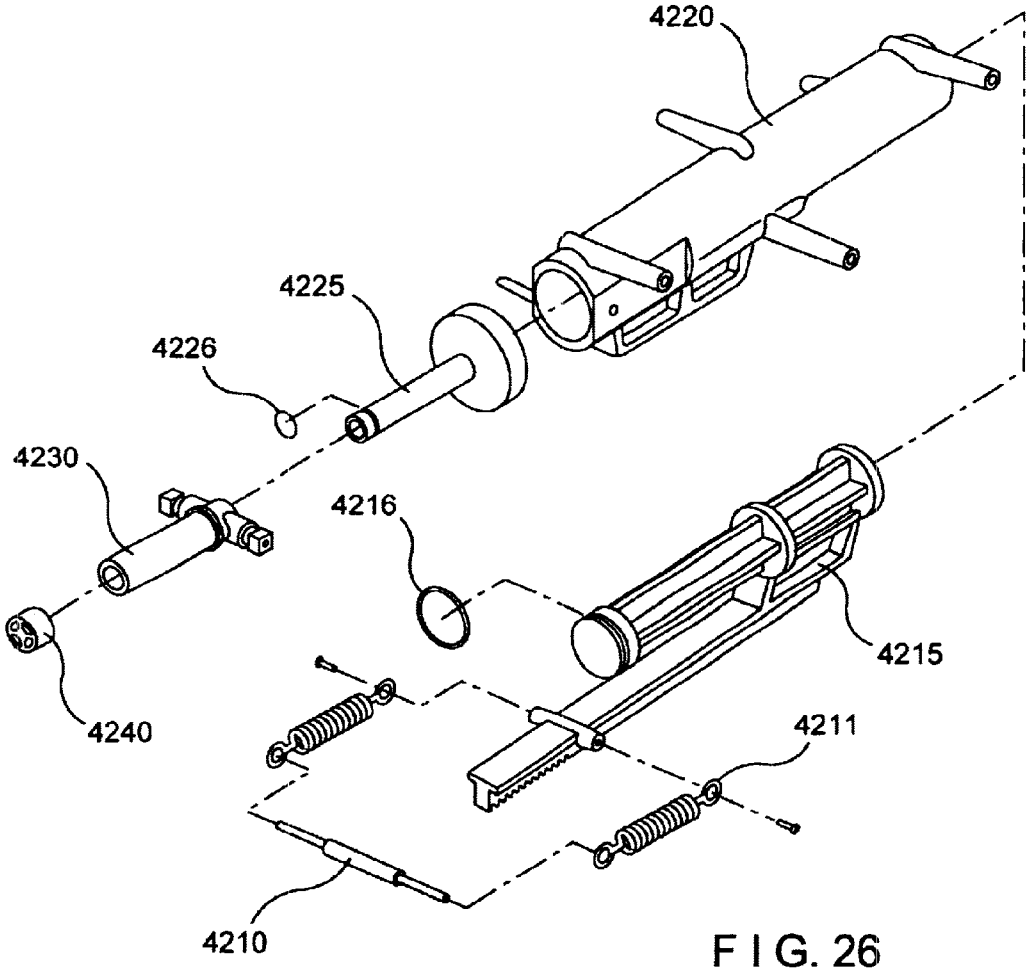
FIG. 26 is an exploded assembly depicting a portion of a motorized firing mechanism for the present invention.
Figure 29:
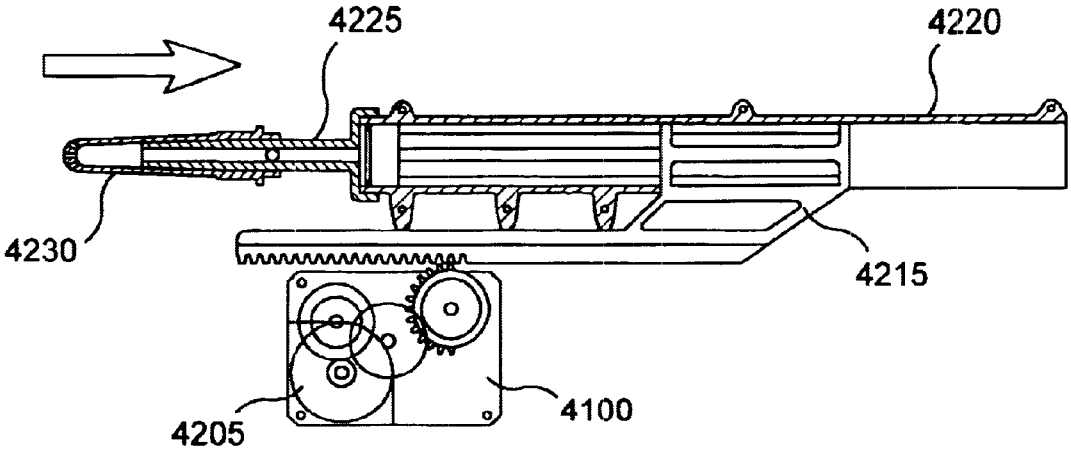
FIG. 29 is a side view of the firing mechanism for an embodiment of the present invention in the resting position.
Figure 30:
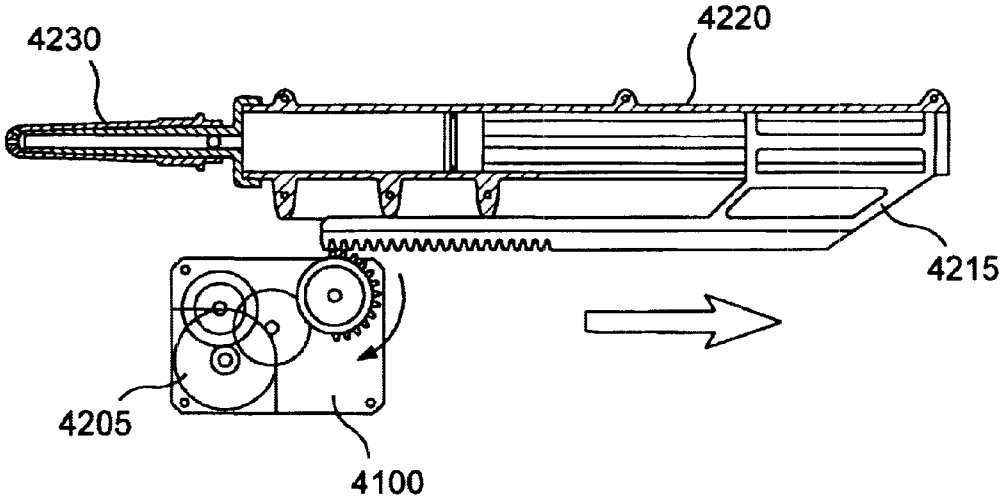
FIG. 30 is a side view of the firing mechanism for an embodiment of the present invention with the plunger arm driven back.
Figure 31:
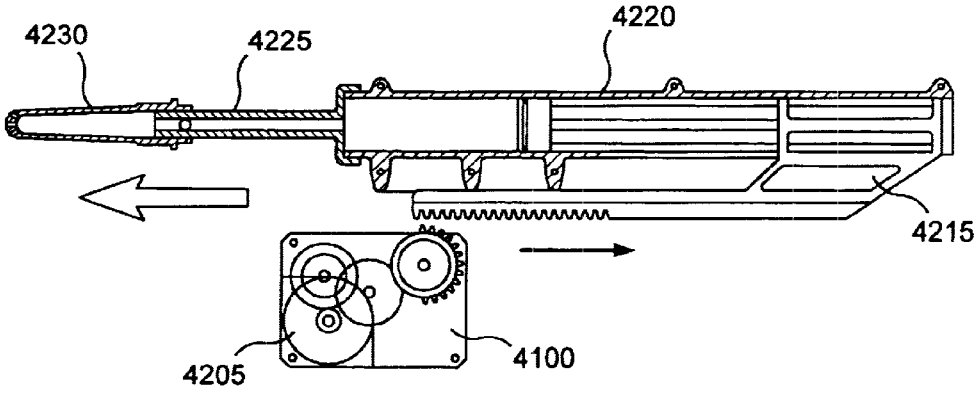
FIG. 31 is a side view of the firing mechanism for an embodiment of the present invention with the firing pin extending forward.

FIG. 26 is an exploded assembly depicting a portion of firing mechanism 4000 for a embodiment having a motorized firing mechanism. In this embodiment, the pumping system is also motorized and the timing of the firing of the firing mechanism is synchronized with the timing of the pumping of the pumping system. The plunger arm 4215 fits within the pump housing 4220 to create a blast of air which propels the projectile 1600 out of the launcher. The plunger arm 4215 fits within a pump housing 4220 where a large o-ring 4216 creates a seal. A spring link 4210 is connected to the right and left shell of the launcher body, respectively. A plunger arm extension spring 4211 connects to each side of the spring link and also attaches to the front side of the plunger arm 4215. The plunger arm extension spring holds the plunger arm 4215 in the resting position in the pump housing 4220 as depicted in FIG. 29. The plunger arm 4215 has grooves where the grooves of the main drive gear 4125 can cause the plunger arm to drive back in the pump housing 4220 as depicted in FIG. 30.

The pump housing 4220 is connected to a pump cover 4225. The pump cover 4225 has a hollow cylindrical shape with the opening being smaller than the opening to the pump housing. The pump cover 4225 fits within the hollow, cylindrically shaped firing pin 4230 where a small o-ring 4226 creates a seal between the pump cover 4225 and the firing pin wall 4230. On the front of the firing pin 4230 is a cruciform 4240 with openings wherein the light source 1330 is contained.

Figure 27:
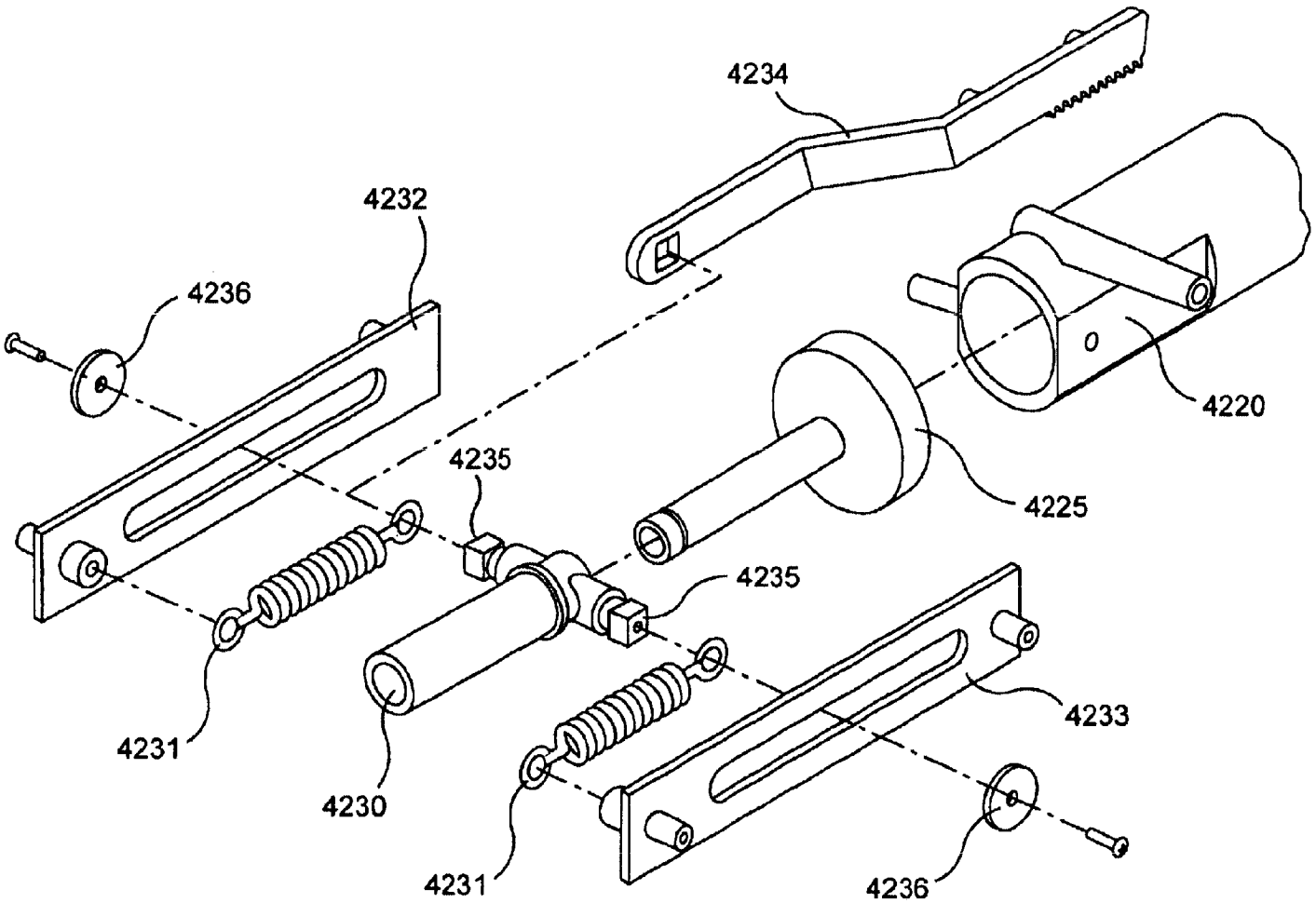
FIG. 27 is an exploded assembly of an embodiment of the firing pin assembly as depicted in FIG. 24.

FIG. 27 is an exploded assembly of the firing pin assembly as depicted in FIG. 24. The firing pin 4230 has a left guide 4235 which fits within a left guide track 4233 and a right guide 4236 which fits within a right guide track 4232. A screw and washer connector 4236 are used to hold each guide in place on the guide tracks. Connected to each guide is a firing pin extension spring 4231 that is anchored to the main body of the launcher. The guide tracks allow for longitudinal movement of the firing pin. The firing pin linkage 4234 is the connection between the firing pin 4230 and the firing pin linkage gear 4120. It is connected to one side of the firing pin on a guide 4236. In the resting position the tension of the firing pin extension springs 4231 causes the firing pin to be at the farthest forward position in the guide tracks as depicted in FIG. 29.

Figure 28:
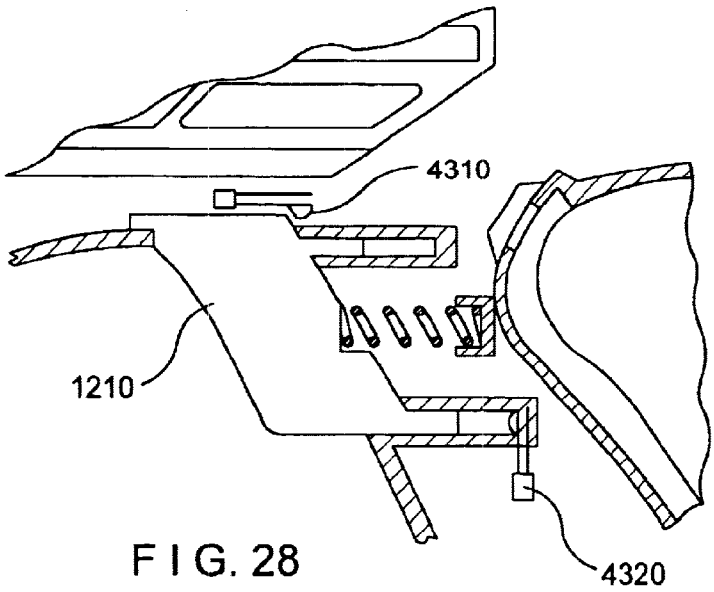
FIG. 28 is a side view of a trigger switch assembly for an embodiment of the present invention.

FIG. 28 is a side view of a trigger switch assembly for an embodiment of the present invention. Switch 4310 may be used to activate the lighting of the scope, the light source and the light-up surfaces or other switches may be used as in other embodiments of the invention. Switch 4320 located in the trigger mechanism is used to actuate the motor. If the trigger is released before one cycle then the launcher will fire only once. However, in some embodiments, if the trigger is continuously held down, then the motor will continuously fire projectiles.

FIGS. 29, 30, 31, and 32 depict the positioning of the mechanisms within the launcher during a firing sequence using a motorized firing and pumping mechanism. FIG. 29 is the motorized firing mechanism 4000 in the resting position, prior to the firing pin 4230 and plunger arm 4215 being retracted. FIG. 30 depicts the firing mechanism moving from the resting position to just after the user pulls the trigger. When the user initially pulls the trigger, the switch 4320 is activated to turn on the motor 4205 and the main drive gear 4125 operates to pull back the plunger arm 4215 and the firing pin linkage gear operates to pull back the firing pin 4230.

Figure 32:
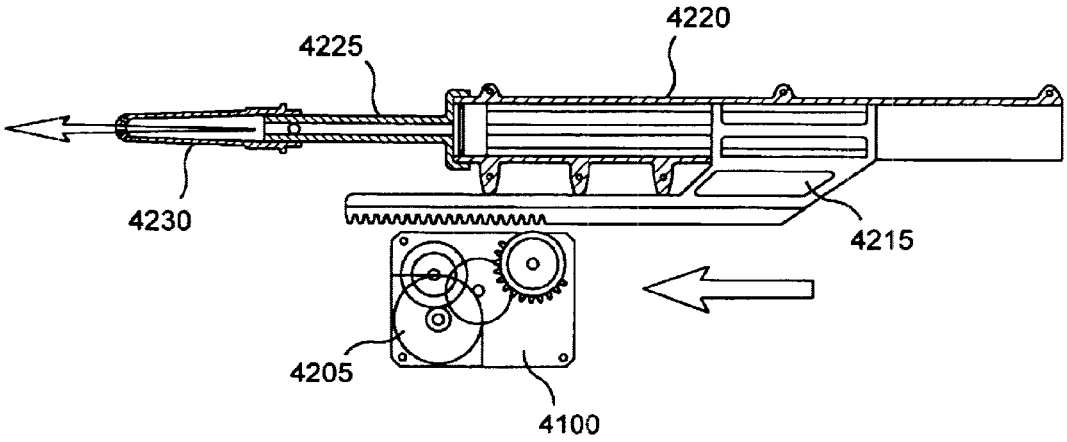
FIG. 32 is a side view of the firing mechanism for an embodiment of the present invention with the plunger arm compressing air to fire a projectile.

Just before the launcher fires the projectile, the firing pin releases forward as shown in FIG. 32. There are gaps in the firing pin linkage gear 4120 to cause the firing pin linkage 4234 to release, which cause the firing pin extension springs 4231 to pull the firing pin 4230 forward into the projectile. In advancing forward, the light source is activated so that the projectile is exposed to radiation from the firing pin.

The main drive gear 4125 may have a gap in the grooves which would result in the main drive gear 4125 disengaging from the plunger arm 4215. This disengagement would cause the plunger arm extension spring 4211 to pull the plunger arm 4215 fully into the pump housing 4220. The compression of the air in the pump housing 4220 causes air to force out through the pump cover 4225, through the cruciform 4240 and to launch the projectile from the launcher as shown in FIG. 32.

The gear system would be synchronized to result in the firing pin first entering the projectile to expose it to radiation and then the pump system to force air out of the pump housing 4220 into the firing pin 4230 to project the projectile out of the launcher.

Although the present invention has been described with reference to preferred embodiments, persons skilled in the art will recognize that changes may be made in form and detail without departing from the spirit and scope of the invention.

What is claimed is:

1. A toy comprising:

a projectile which glows in the dark; and a projectile launcher comprising a firing mechanism, the firing mechanism comprising:

a barrel;

a valve system;

a firing pin; and a firing spring, wherein a portion of the firing mechanism is positioned within the projectile before being fired, wherein the firing pin is the portion of the firing mechanism positioned within the projectile.

2. The toy of claim 1, wherein the tip of the firing pin comprises a cruciform.

3. The toy of claim 2, wherein the cruciform comprises a light source.

4. The toy of claim 1, wherein the projectile launcher further comprises a projectile container.

5. The toy of claim 1, wherein the projectile launcher further comprises a scope.

6. The toy of claim 1, wherein the firing mechanism further comprises a trigger mechanism comprising:

a trigger;

a trigger arm;

a gear system; and a draw pin.

7. The toy of claim 5, wherein the scope comprises a light source activated by a trigger mechanism.

8. A toy comprising:

a projectile which glows in the dark; and a projectile launcher comprising:

a body;

a trigger mechanism;

a firing mechanism, wherein a portion of the firing mechanism is positioned within the projectile before being fired; and a pumping system comprising a pump arm and a pump body, whereby air is manually pumped into the pump body.

9. The toy of claim 8 wherein the pumping system comprises a tank designed to hold gas under pressure.

10. A toy comprising:

a projectile which glows in the dark; and a projectile launcher comprising:

a body;

a trigger mechanism;

a firing mechanism, wherein a portion of the firing mechanism is positioned within the projectile before being fired; and a pumping system comprising a pump body and a motor, whereby air is automatically pumped into the pump body when the motor is actuated.

11. The toy of claim 10 wherein the pumping system comprises a tank designed to hold gas under pressure.

12. The toy of claim 1, wherein the projectile has a generally cylindrical hollow shape designed for receiving the firing pin.

13. The toy of claim 3, wherein the light source is actuated by the firing mechanism contacting a switch.

14. A toy comprising:

a projectile which glows in the dark; and a projectile launcher comprising a firing mechanism, the firing mechanism comprising:

a barrel;

a valve system;

a firing pin; and a firing spring, wherein a portion of the firing mechanism is positioned within the projectile before being fired, wherein the firing pin comprises a generally central longitudinal axis and wherein the projectile comprises a generally central longitudinal axis and wherein the firing pin axis and the projectile axis align generally coaxially for the firing pin to enter into the projectile prior to firing.

15. A toy comprising:

a projectile launcher comprising a body, a trigger mechanism, and a firing mechanism comprising a light source located within the firing mechanism, and a pumping system comprising a pump arm and a pump body; and a hollow projectile adapted to glow in the dark wherein the inner portion of the hollow projectile is exposed to said light source before being launched from said projectile launcher.

16. The toy of claim 15, wherein air is manually pumped into the pump body by the pump arm.

17. The toy of claim 15, wherein the pumping system comprises a tank to hold gas under pressure.

18. The toy of claim 15, wherein the pumping system comprises a motor, whereby air is automatically pumped into the pump body when the motor is actuated.

19. The toy of claim 15, wherein the firing mechanism comprises a firing pin comprising a generally central longitudinal axis and wherein the hollow projectile comprises a generally central longitudinal axis and wherein the firing pin axis and the hollow projectile axis align generally coaxially for the firing pin to enter into the projectile prior to firing and wherein the light source is carried on the firing pin such that when the firing pin enters the projectile and the light source is actuated it illuminates the interior of the projectile.

* * * * *